US012448675B2

(12) United States Patent
Christiansen et al.

(10) Patent No.: US 12,448,675 B2
(45) Date of Patent: Oct. 21, 2025

(54) LOW TEMPERATURE TITANIUM HARDENING

(71) Applicant: ELOS MEDTECH PINOL A/S, Gørløse (DK)

(72) Inventors: Thomas Lundin Christiansen, Frederikssund (DK); Morten Stendahl Jellesen, Søborg (DK); Marcel A. J. Somers, Billund (DK); Andreas Frederik Kielsholm Körkel, Græsted (DK)

(73) Assignee: ELOS MEDTECH PINOL A/S, Gørløse (DK)

( * ) Notice: Subject to any disclaimer, the term of this patent is extended or adjusted under 35 U.S.C. 154(b) by 854 days.

(21) Appl. No.: 17/637,431

(22) PCT Filed: Aug. 21, 2020

(86) PCT No.: PCT/EP2020/073556
§ 371 (c)(1),
(2) Date: Feb. 22, 2022

(87) PCT Pub. No.: WO2021/037757
PCT Pub. Date: Mar. 4, 2021

(65) Prior Publication Data

US 2022/0275495 A1 Sep. 1, 2022

(30) Foreign Application Priority Data

Aug. 23, 2019 (EP) ..... 19193358

(51) Int. Cl.
*C23C 8/16* (2006.01)

(52) U.S. Cl.
CPC ..... *C23C 8/16* (2013.01)

(58) Field of Classification Search
CPC .... C23C 8/12; C23C 8/16; C23C 8/28; C23C 8/80
See application file for complete search history.

(56) References Cited

U.S. PATENT DOCUMENTS 4,478,648 A 10/1984 Zeilinger et al.
4,478,658 A 10/1984 Wittwer
(Continued)

FOREIGN PATENT DOCUMENTS

CN 101925681 A 12/2010
EP 0905271 A1 3/1999
(Continued)

OTHER PUBLICATIONS

Kim et al., "Surface Hardening Treatment for C.P. Titanium and Titanium Alloys in Use of Ar—5%CO Gas", ISIJ International, 2006, 46(9): 1329-1338.

*Primary Examiner* — Lois L Zheng
(74) *Attorney, Agent, or Firm* — James S. Keddie; Bozicevic, Field & Francis LLP

(57) ABSTRACT

The present invention relates to a method of oxygen hardening a Group IV metal, the method comprising the steps of: providing a workpiece of a Group IV metal in its final shape; oxidising the Group IV metal over an oxidising duration of at least 10 minutes in an oxidising atmosphere at a first temperature to provide a non-stratified Group IV metal oxide on the surface of the workpiece using a gaseous oxidising species having an upper temperature limit of up to 800° C. wherein the first temperature is in the range of 500° C. and the upper temperature limit of the gaseous oxidising species; diffusing oxygen from the non-stratified Group IV metal oxide into the Group IV metal in an inert atmosphere at a second temperature in the range of 500° C. to 800° C. and at a partial pressure of the gaseous oxidising species of up to 10-4 mbar over a diffusive duration of at least 0.1 hour
(Continued)

to provide a superficial diffusion zone comprising oxygen in solid solution. In another aspect, the invention relates to a Group IV metal component comprising a material core having a core hardness and a surface hardness of at least the core hardness +200 $HV_{0.025}$. The component is obtainable in the method of the invention.

23 Claims, 8 Drawing Sheets

(56) References Cited

U.S. PATENT DOCUMENTS

| | | | |
|---|---|---|---|
| 6,221,173 | B1 | 4/2001 | Shibuya et al. |
| 6,328,819 | B1 | 12/2001 | Lerche et al. |
| 6,833,197 | B1 | 12/2004 | Dong et al. |
| 8,168,012 | B2 | 5/2012 | Steinemann |
| 2001/0053460 | A1* | 12/2001 | Sato ..... C23C 8/34 148/237 |
| 2003/0041922 | A1 | 3/2003 | Hirose et al. |
| 2003/0118858 | A1 | 6/2003 | Kushida et al. |
| 2005/0234561 | A1 | 10/2005 | Nutt et al. |
| 2010/0269960 | A1 | 10/2010 | Hertz |
| 2022/0280692 | A1 | 9/2022 | Christiansen et al. |

FOREIGN PATENT DOCUMENTS

| | | | |
|---|---|---|---|
| EP | 0931848 | A1 | 7/1999 |
| GB | 2159542 | B | 3/1988 |
| JP | H059702 | A | 1/1993 |
| JP | H059703 | A | 1/1993 |
| JP | H0797676 | A | 4/1995 |
| JP | H08104970 | A | 4/1996 |
| JP | H08134625 | A | 5/1996 |
| JP | H1192910 | A | 4/1999 |
| JP | H1192911 | A | 4/1999 |
| WO | WO 97/14820 | A1 | 4/1997 |
| WO | WO 99/04055 | A1 | 1/1999 |
| WO | WO 2007/078427 | A2 | 7/2007 |
| WO | WO 2008/154593 | A1 | 12/2008 |
| WO | WO 2017/207794 | A1 | 12/2017 |

* cited by examiner

LOW TEMPERATURE TITANIUM HARDENING

CROSS-REFERENCE TO RELATED APPLICATIONS

This application is a § 371 national phase of International Application No. PCT/EP2020/073556, filed on Aug. 21, 2020, which claims the benefit of European Application No. 19193358.9, filed on Aug. 23, 2019, which applications are incorporated by reference herein.

FIELD OF THE INVENTION

The present invention relates to low temperature hardening of titanium and other Group IV metals. Specifically, a method of oxygen hardening a Group IV metal is provided as well as a hardened Group IV metal component. The method and the component are useful for any application where hard metals can be used. The component of the invention is especially useful where the aesthetics of the metal is important, e.g. for watches, jewellery, and glasses.

PRIOR ART

It is well-known that titanium and other Group IV metals can be hardened by interstitial oxygen and that there is a direct correlation between the oxygen content and the hardness, the higher the oxygen content the harder the metal. It is further well-known that oxygen hardening of titanium should be performed at a temperature as low as possible in order to avoid grain growth and general distortion of the material.

Thus, JPH08134625 discloses a method of forming and surface-hardening titanium or titanium alloy sheet. The method employs a forming gas containing $CO_2$ gas, and by performing gas pressure forming, the titanium thin plate can be formed into a predetermined shape, and at the same time a hardened layer is formed. The method is done between 700° C. and 1100° C., although a temperature lower than the β transformation point is preferred. Above 1100° C. excessive oxidising is found.

JPH059703 discloses a surface hardening treatment method of a titanium material. The titanium material is heat treated in an atmosphere containing a $CO_2$ gas, which is reduced and decomposed into oxygen and carbon, so that the surface of the titanium material is hardened by solid solution strengthening with these as interstitial elements. A temperature of 700° C. or more is used and a curing time within 10 hours is preferred.

JPH08104970 discloses a surface hardening treatment of a titanium material, aiming to easily form a thick surface-hardened layer without roughening of the surface. The titanium surface is hardened by heating to a predetermined heating temperature in an atmosphere consisting of a $CO_2$ gas and an inert gas or a nitrogen gas, and then in an inert gas or vacuum. Specifically, oxygen and carbon atoms were found to penetrate into the surface of a titanium material by heating with a specific partial pressure of $CO_2$ gas, and a heat treatment in an inert gas or vacuum caused the oxygen and carbon to diffuse inside, thereby forming a thick hardened layer with small surface roughness. In an example, pure titanium was heated in a mixed gas of $CO_2$ and argon for 3 hours at 800° C. followed by diffusion heat treatment at 850° C. for 3 hours in vacuum.

JPH1192911 aims to cure a titanium member at a temperature which does not cause surface roughness, but forms a Vickers hardness of at least 750 at a depth of 1 μm from the surface without forming a coloured substance on the surface. In the process, the member is heated to 700 to 800° C. and treated in a reduced pressure atmosphere containing a nitrogen component and an oxygen component. Nitrogen monoxide, nitrogen dioxide or nitrous oxide, or ammonia gas can be used as the nitrogen containing component, and water or oxygen can be used as the oxygen containing component. For example, a titanium member can be treated at 0.3 Torr of nitrous oxide at 700-800° C. for 1 to 10 hours.

U.S. Pat. No. 6,221,173 discloses a titanium or titanium alloy having a hard surface layer comprising a first hard layer containing nitrogen in solid solution in a range of 0.6 to 8.0 wt % and oxygen in solid solution in a range of 1.0 to 14.0 wt % and a second hard layer below the first hard layer containing oxygen in solid solution in a range of 0.5 to 14.0 wt %. The hard surface layer can be provided by treating the alloy at 650 to 830° C. in a nitrogen atmosphere with traces of oxygen, water, carbon dioxide or carbon monoxide at a total pressure of 1.33 to 1330 Pa. The length of treatment time is from 1 to 10 hours. Thereby, nitrogen and oxygen diffuse into the interior of the titanium or titanium alloy without forming nitrides and oxides of the titanium.

US 2003/041922 discloses a method of strengthening a titanium alloy to improve wear resistance. The method comprising heating the titanium alloy in an atmosphere of $CO_2$ at 600 to 900° C. to diffuse C and O atoms into the titanium alloy without forming titanium oxide. A preferred temperature range is 800 to 850° C., and in particular at temperatures above 900° C., titanium oxides are formed. The reaction time may be 0.5 to 50 hours.

WO 97/14820 discloses a method of treating titanium parts at atmospheric pressure in a mixture of nitrogen, methanol and optionally natural gas or propane at a temperature between 1450° F. and 1850° F. Thereby a coating is caused to form on the alloy surface consisting predominantly of titanium oxides with regions of oxynitrides and at times some carbonitrides. The part can then be treated in a vacuum furnace at 1200° F. to 1450° F. to reduce the hydrogen level in the parts to improve yield strength.

WO 2008/154593 and WO 2007/078427 disclose medical implants of zirconium having a diffusion hardened zone and optionally also a ceramic zone having a layered structure comprising, and a method of making a surface hardened medical implant. For example, a zirconium niobium alloy sample is oxidised in air at 635° C. followed by treatment in a vacuum furnace.

WO 2017/207794 discloses a case hardened component of a titanium alloy having a diffusion zone comprising oxygen and carbon in solid solution and having a distinct phase of a carbo-oxide compound.

EP 0931848 discloses a decorative hardened titanium material, a method of processing a titanium material, and a method of processing a decorative titanium material. The hardened surface layer including nitrogen and oxygen and has a surface crystal grain size in the range from 0.1 to 60 μm.

WO 99/04055 discloses a method of case hardening an article formed of titanium, zirconium or an alloy of titanium and/or zirconium. The method involves heat-treating the article in an oxidising atmosphere to form an oxide layer followed by heat-treating the article in a vacuum to cause oxygen from the oxide layer to diffuse into the article.

In light of the methods disclosed by the prior art there is still a need for an improved process of hardening titanium or other Group IV metals and their alloys.

DISCLOSURE OF THE INVENTION

In a first aspect, the present invention relates to a method of oxygen hardening a Group IV metal, the method comprising the steps of:

providing a workpiece of a Group IV metal in its final shape;

oxidising the Group IV metal over an oxidising duration of at least 10 minutes in an oxidising atmosphere at a first temperature to provide a non-stratified Group IV metal oxide on the surface of the workpiece using a gaseous oxidising species selected from $CO_2$, $N_2O$ and combinations of $CO_2$ and $N_2O$, the gaseous oxidising species having an upper temperature limit of up to 800° C. wherein the first temperature is in the range of 500° C. and the upper temperature limit of the gaseous oxidising species;

diffusing oxygen from the non-stratified Group IV metal oxide into the Group IV metal in an inert atmosphere at a second temperature in the range of 500° C. to 800° C. and at a partial pressure of the gaseous oxidising species of up to $10^{-4}$ mbar over a diffusive duration of at least 0.1 hour to provide a superficial diffusion zone comprising oxygen in solid solution.

In a second aspect, the present invention relates to a Group IV metal component comprising a material core having a core hardness and a surface hardness of at least the core hardness +200 $HV_{0.025}$, a diffusion zone having oxygen in solid solution in the range of a level providing a hardness of 120% of the hardness of the material core to the saturation level of the Group IV metal over a thickness from the surface in the range of 10 μm to 100 μm, the diffusion zone further containing carbon and/or nitrogen in solid solution at a concentration showing a local maximum in the diffusion zone of the carbon content and/or the nitrogen content as detectable with Glow Discharge Optical Emission Spectroscopy (GDOES).

The Group IV metal component of the second aspect is obtainable in the method of the first aspect. In particular, the Group IV metal component of the second aspect is obtainable when the oxidising atmosphere comprises a carbon containing molecule or a nitrogen containing molecule, or both a carbon containing molecule and a nitrogen containing molecule.

Any Group IV metal is appropriate for both aspects of the invention. In specific embodiments the Group IV metal is selected from the list of titanium, titanium alloys, zirconium and zirconium alloys. In the context of the invention the component may consist of a Group IV metal, e.g. a titanium alloy, or it may comprise other materials. For example, the component may have a core of another material, a polymer, glass, ceramic or another metal, and an outer layer of the titanium alloy or zirconium. Likewise, a workpiece treated in the method of the invention may also have a core of another material. The outer layer need not completely cover the outer surface of the component. The component may for example be prepared from additive manufacturing or 3D printing prior to be treated in the methods of the invention.

Group IV metals, and their alloys, can be described in terms of their hardness. Group IV metals can be hardened by dissolution of oxygen in the metal, but regardless of any oxygen hardening, the Group IV metal will have a core hardness. Thus, the core hardness corresponds to the hardness, e.g. the surface hardness, of the Group IV metal before hardening. The core hardness generally depends on the specific Group IV metal, but when the Group IV metal has been treated in the method of the invention, the surface hardness will at least 200 $HV_{0.025}$ units higher than the core hardness. It is preferred that the surface hardness is analysed using load of up to 50 g, i.e. $HV_{0.05}$, although any value for surface hardness will be $HV_{0.025}$ unless noted otherwise. Surface hardness values obtained using loads of up to 50 g, e.g. $HV_{0.01}$, $HV_{0.025}$ or $HV_{0.005}$, are considered to be representative also for the $HV_{0.025}$-value. Grade 2 titanium will typically have a core hardness of about 200 $HV_{0.025}$, so that Grade 2 titanium hardened according to the invention will have a surface hardness of at least 400 $HV_{0.025}$. Grade 5 titanium will typically have a core hardness of about 300 $HV_{0.025}$, so that Grade 5 titanium hardened according to the invention will have a surface hardness of at least 500 $HV_{0.025}$. However, in general higher surface hardnesses are available from the method of the invention. In a specific embodiment, the surface hardness is at least 650 $HV_{0.025}$. A surface hardness is at least 650 $HV_{0.025}$ can be obtained for any Group IV metal. It is preferred that the surface hardness is at least 700 $HV_{0.025}$, e.g. at least 800 $HV_{0.025}$.

The method of the invention allows that the workpiece after treatment according to the method regains its metallic lustre so that a component of the invention cannot be differentiated from the workpiece before treatment by visual inspection. Thus, when the workpiece has a mirror polish appearance the mirror polish appearance will also be found on the component after treatment in the method. In the context of the invention, a "mirror polish appearance" is defined as a surface with an arithmetical mean deviation (Ra) roughness of <0.1 μm in accordance with the ISO 1302:2002 standard. For example, the Ra value can be measured using a Taylor-Hubson Surtronic S25 measuring over a length of 1.25 mm. A mirror polish surface may also be referred to as an N3 surface, and the two terms can be used interchangeably. In a preferred embodiment, the workpiece of a Group IV metal is polished prior to oxidising the Group IV metal to provide a surface roughness of <0.1 μm in accordance with the ISO 1302:2002 standard. The surface roughness of <0.1 μm will also be observed for the workpiece after the diffusion step. A mirror polish appearance is generally available for Group IV metals, titanium in particular, but when the workpiece contains aluminium, e.g. Grade 5 titanium, the first temperature should not be higher than 700° C. for the method to provide a mirror polish appearance. However, it is preferred that the Group IV metal does not contain aluminium when a mirror polish appearance is relevant. Furthermore, the oxidising atmosphere should not contain carbon containing molecules, other than $CO_2$, when a mirror polish appearance is relevant. When the gaseous oxidising species is $CO_2$ and the oxidising atmosphere is not supplemented with further carbon containing molecules a commercially pure (CP) titanium, e.g. Grade 2 or Grade 4, can be provided with a surface hardness of at least 1100 $HV_{0.025}$ while retaining the mirror polish appearance. Thus, the method of the invention provides a titanium component having a mirror polish appearance with a surface hardness of at least 1100 $HV_{0.025}$. The presence of further carbon containing molecules as unavoidable impurities does not affect the mirror polish appearance.

The present inventors have surprisingly found that if the Group IV metal comprises aluminium as an alloying element, the metallic appearance after treatment will be duller than when a workpiece made from a Group IV metal not comprising aluminium is treated. Without being bound by theory the present inventors believe that aluminium forms thermodynamically more stable oxides than the Group IV metal in the oxidising step thereby preventing that all oxygen is diffused into the Group IV metal in the diffusion step. However, unavoidable impurities of aluminium will not cause problems for the formation of metallic lustre on the Group IV metal. The present inventors have further observed that when aluminium is present, a higher surface hardness is available than when no aluminium is present. In a preferred embodiment, the Group IV metal does not comprise aluminium as an alloying element. In a particularly preferred embodiment, the Group IV metal is a CP Group IV metal, e.g. titanium of the grades 2 and 4, or Zr702 zirconium. In another embodiment, the Group IV metal comprises aluminium, e.g. the Group IV metal may be Grade 5 titanium, which is also known as Ti6Al4V, or Ti6Al4V ELI also known as Grade 23. When the Group IV metal is of CP grade, it is possible to obtain a mirror polish appearance after treatment in the method of the invention. The workpiece treated or the component of the invention may comprise aluminium, e.g. as a section separate from the Group IV metal, while the Group IV metal does not comprise aluminium as an alloying element. In an embodiment of the invention, the component of the invention, e.g. of titanium of grade 2 or 4, has a mirror polish appearance. A mirror polish appearance may not be available when the oxidising atmosphere contains other carbon containing molecules than $CO_2$, since additional carbon, e.g. CO, tends to provide a darker non-stratified oxide layer, which may be reflected in the surface of the final component. It is therefore a preferred embodiment that the oxidising atmosphere does not contain CO. Likewise, a component of the invention having a mirror polish appearance is available using $CO_2$ as the oxidising atmosphere.

The method of the invention in an oxidising step provides a Group IV metal with a layer of Group IV metal, e.g. titanium oxide or zirconium oxide, which serves as a reservoir for oxygen atoms that in the diffusion step are diffused into the Group IV metal to form interstitially dissolved oxygen in the Group IV metal. The oxidising step may also be referred to as the first step. The present inventors have surprisingly found that it is possible to form an intermediary non-stratified oxide layer that is so robust and stably integrated with the Group IV metal that oxygen atoms can be diffused into the Group IV metal to form a superficial diffusion zone comprising oxygen in solid solution. The diffusion takes places in the diffusion step after the oxidising step, and the diffusion step may also be referred to as the second step. Thus, the non-stratified oxide layer will effectively be removed from the surface to be replaced with the diffusion zone, and the Group IV metal will be returned to its apparent metallic state but with a greatly increased surface hardness, i.e. at least 200 $HV_{0.025}$ units higher than the core hardness, e.g. at least 650 $HV_{0.025}$, or at least 800 $HV_{0.025}$, or at least 1000 $HV_{0.025}$, due to the interstitial oxygen. Even though the oxide layer is removed in the diffusion step, a natural oxide layer will inevitably form on the surface of the hardened Group IV metal. A naturally formed oxide layer will be in the nanometer range and will not change the metallic appearance of the hardened Group IV metal.

The method of the invention uses a gaseous oxidising species. Any gaseous oxidising species that can be brought to a gaseous form may be used in the method. The oxide layer provided in the oxidising step is non-stratified, and the present inventors have found that the first temperature and also the oxidising duration can be chosen based on the oxidising capability of commonly used gaseous oxidising species to provide the non-stratified oxide layer. In the context of the invention, the workpiece with the non-stratified oxide layer may be referred to as the "intermediary workpiece", and the two terms may be used interchangeably. Stratification of the oxide layer is an indication that the oxide layer has insufficient stability to serve as a reservoir for oxygen atoms for diffusion into the Group IV metal. In general, the oxidising capabilities of $CO_2$, $O_2$ and $N_2O$ can be ranked as follows: $CO_2<O_2<N_2O$. A temperature below 500° C. is too low to form the oxide layer, but an upper temperature limit can be determined for a gaseous oxidising species. Water vapour, i.e. $H_2O$ is also contemplated as a gaseous oxidising species. However, when hydrogen containing molecules are present in the oxidising atmosphere, or even in the inert atmosphere, hydrogen will dissolve in the Group IV metal where the presence of interstitial hydrogen will lead to embrittlement of the Group IV metal. Thus, it is preferred that neither the oxidising atmosphere nor the inert atmosphere contains hydrogen containing molecules, in particular $H_2O$.

Regardless of the choice of gaseous oxidising species it is preferred that the first temperature is in the range of 600° C. to 700° C. At a first temperature in the range of 500° C. to 600° C., the oxidising step will generally be undesirably slow, but if the first temperature is at least 600° C. the workpiece will be oxidised at an acceptable rate. When the first temperature is in the range of 700° C. to 800° C., i.e. when possible with regard to the chosen gaseous oxidising species, grain growth may be observed for the Group IV metal, so that when grain growth is unacceptable, the first temperature should be up to 700° C., e.g. in the range of 500° C. to 700° C., or in the range of 600° C. to 700° C.

The oxidising step has an oxidising duration. The oxidising duration is determined by the time the workpiece is treated with the gaseous oxidising species at the first temperature. The workpiece may be heated, e.g. from ambient temperature, to the first temperature before being exposed to the gaseous oxidising species or the workpiece, e.g. at ambient temperature, may be exposed to the gaseous oxidising species being at the first temperature. When the workpiece is heated prior to exposure to the gaseous oxidising species, the workpiece may be heated in an inert atmosphere, in vacuum or in the gaseous oxidising species, it is preferred that the time the workpiece spends in the temperature from 500° C. to the first temperature is minimised.

In general, the thickness of the oxide layer is determined by the oxidising duration, with due consideration of the oxidising capability of the gaseous oxidising species employed. The longer the oxidising duration, the thicker the oxide layer, and in general, dissolution of elements into a Group IV metal is considered to be parabolic so that a doubling of the dissolution depth requires a four times longer reactive duration. The composition of the oxide layer will generally be $MeO_2$, where "Me" is the Group IV Metal, e.g. $TiO_2$, or $ZrO_2$, although trace amounts of other elements, e.g. carbon and/or nitrogen or other metals from alloys of the Group IV metal, may also be present. Therefore, the thickness of the diffusion zone will depend proportionally on the thickness of the oxide layer. A thickness of only 1 μm of the oxide layer is considered sufficient to provide a diffusion zone of a thickness to provide a surface hardness of the core hardness plus at least 200 $HV_{0.025}$ and a hardness profile over the cross-section to identify the diffusion zone, regardless of the Group IV metal treated in the method. A thickness of the oxide layer of at least 2 μm is considered sufficient to provide a diffusion zone of a thickness to provide a surface hardness of at least 650 $HV_{0.025}$. However, it is preferred that the oxidising duration is sufficient to provide a thickness of the non-stratified oxide layer in the range of 5 μm to 15 μm. The oxidising duration for providing a non-stratified oxide layer with a thickness in the range of 5 μm to 15 μm can be determined by inspection of the cross-section of intermediary workpieces.

Once the oxide layer is formed, the intermediary workpiece can be stored as long as desired before treating in the diffusion step. The non-stratified oxide layer is so stable that normal handling of the intermediary workpiece will not affect the non-stratified oxide layer. Therefore, the method of the invention is highly flexible since the oxidising step can be performed in a first oven, e.g. an oven without vacuum capabilities, and the transferred to another oven that does have vacuum capabilities. This advantageously allows for logistical optimisation of producing the component of the invention. Moreover, the stability of the non-stratified oxide layer and the intermediary workpiece allows that the conditions of the diffusion step can be selected independently from the choice of oxidising gaseous species employed in the oxidising step.

$CO_2$ as the gaseous oxidising species, being the mildest gaseous oxidising species, allows formation of a stable, non-stratified oxide layer at any temperature at or above 500° C. without regard to the oxidising duration. However, in order to limit deformation and grain growth in the Group IV metal, the upper temperature limit of $CO_2$ is 800° C. For practical reason and in order to limit thickness of the oxide layer the oxidising duration with $CO_2$ may be up to 16 hours, although stable non-stratified oxide layers will also form in longer oxidising durations. For $CO_2$ the oxidising duration is preferably in the range of 1 hour to 16 hours.

$N_2O$ is the most capable gaseous oxidising species of commonly used gaseous oxidising species, and $N_2O$ has an upper temperature limit of 700° C. Likewise, the non-stratified oxide layer can be formed faster than for $CO_2$, and it is preferred that the oxidising duration is in the range of 10 minutes to 2 hours for $N_2O$. In a certain embodiment, $N_2O$ is preferred as the gaseous oxidising species since the first temperature can be lower, e.g. in the range of 500° C. to 650° C., which further decreases the risk of deformation and grain growth in the Group IV metal.

It is also contemplated that $O_2$ may be used as the gaseous oxidising species. However, when $O_2$ is used as the gaseous oxidising species, the diffusion zone will not contain carbon and/or nitrogen in solid solution from the oxidising treatment. $O_2$ has a higher oxidising capability than $CO_2$ and the upper temperature limit is 750° C. The higher oxidising capability of $O_2$ compared to $CO_2$ also limits the oxidising duration. Thus, if the gaseous oxidising species is $O_2$, the oxidising duration is limited to 3 hours in order to prevent formation of a stratified oxide layer. With $O_2$ as the gaseous oxidising species, an oxidising duration of 30 minutes is considered to provide a non-stratified oxide layer of sufficient thickness to provide a surface hardness of at least 1000 $HV_{0.025}$ after the diffusion step. The oxidising duration for $O_2$ as the gaseous oxidising species is preferably in the range of 30 minutes to 3 hours.

FIG. 1 and FIG. 2 show cross-sections of oxide layers provided using $CO_2$ and $N_2O$ at different temperatures. Specimens of CP Grade 4 titanium were treated in $CO_2$ or $N_2O$ at ambient pressure, and the cross-sections analysed microscopically, and the results are shown in FIG. 1 and FIG. 2. Thus, treatment in $CO_2$ at all tested temperatures over all tested times resulted in formation of robust and stable layers of titanium oxide. FIG. 2 shows that treatment of Grade 4 titanium in $N_2O$ at 780° C. or higher resulted in formation of strongly stratified oxide layers, whereas treatment at 680° C. resulted in a stable, non-stratified oxide layer. The limits for formation of stratified titanium oxide layers vs. non-stratified titanium oxide layers when using $N_2O$ as the gaseous oxidising species CP Grade 2 titanium are illustrated in FIG. 15, in which any combination of first temperatures and oxidising durations below the dotted line will provide a non-stratified titanium oxide layer. Specific combinations of first temperatures and oxidising durations using $N_2O$ as the gaseous oxidising species for treatment of titanium providing non-stratified titanium oxide layers are provided in Table 1. The combinations of first temperature and oxidising durations in Table 1 provide non-stratified titanium oxide layers, and the combinations are considered to represent limit values, so that increasing the first temperature beyond the value in Table 1 while retaining the oxidising duration will result in a stratified titanium oxide layer. Preferred combinations of first temperatures and oxidising durations for $CO_2$ and $N_2O$, when each are used alone as the gaseous oxidising species, are shown in Table 2. When $CO_2$ and $N_2O$ are used in combination, the temperature and time for $N_2O$ will be used.

TABLE 1

Limit combinations of first temperatures and oxidising durations using $N_2O$ as the gaseous oxidising species for treatment of titanium.

| Temperature [° C.] | 600 | 650 | 700 | 750 | 800 | 850 |
|---|---|---|---|---|---|---|
| Time [hours] | 100 | 25 | 8 | 3 | 1 | 0.5 |

TABLE 2

Preferred combinations of gaseous oxidising species, first temperatures and oxidising durations

| Gaseous oxidising species | First temperature | Oxidising duration |
|---|---|---|
| $CO_2$ | 500° C. to 800° C. | 1 hour to 16 hours |
| $CO_2$ | 600° C. to 750° C. | 1 hour to 8 hours |
| $CO_2$ | 620° C. to 680° C. | 2 hours to 6 hours |
| $N_2O$ | 500° C. to 700° C. | 10 minutes to 2 hours |
| $N_2O$ | 550° C. to 600° C. | 30 minutes to 2 hours |

When $O_2$ is used as the oxidising species, the first temperature may be in the range of 500° C. and 750° C. with an oxidising duration in the range of 30 minutes to 3 hours, or the first temperature may be in the range of 600° C. and 650° C. with an oxidising duration in the range of 30 minutes to 2 hours.

It is preferred that the pressure in the oxidising atmosphere is ambient pressure. It is further preferred that the gaseous oxidising species is at ambient pressure, i.e. that the oxidising atmosphere does not contain other molecules. However, it is also contemplated that the oxidising atmosphere may be at ambient pressure and that the partial pressure of the gaseous oxidising species is reduced by the addition of an inert gas, e.g. a noble gas such as argon or helium. Operation at ambient pressure simplifies the process compared to operation at amended, in particular lowered, pressures. When the oxidising atmosphere contains CO, it is preferred that the pressure of the oxidising atmosphere is at ambient pressure.

The oxidising atmosphere may also contain further molecules that can provide atoms for diffusion into the Group IV metal, and which can be integrated in the non-stratified oxide layer. The oxidising atmosphere may for example be ambient air where $O_2$ is the gaseous oxidising species thus being present at about 20% or a partial pressure of about 0.2 atm and is mixed with $N_2$ at about 80% or a partial pressure of about 0.8 atm. The presence of $N_2$ can increase the hardness of the treated workpiece although dissolution of nitrogen atoms from $N_2$ may change the appearance of the surface so that a mirror polish appearance will not be available with $N_2$ is present in the oxidising atmosphere. It is therefore preferred that atmospheric air is not employed, and likewise it is preferred that $N_2$ is not included in the oxidising atmosphere. However, interstitial nitrogen in the component of the invention or a workpiece treated in the method of the invention provides an increased hardness, both of the surface and also the cross-sectional hardness in the diffusion zone.

Oxidising a workpiece of a Group IV metal will increase the volume of the workpiece, due to the inclusion of the oxygen atoms in the oxide layer. Thus, the intermediary workpiece will have a larger volume than the untreated workpiece. However, the inventors have now surprisingly found that when the intermediary workpiece is treated in the diffusion step, the oxygen atoms will diffuse into the Group IV metal and return the component to its original dimensions in the untreated state before the first oxidising step. However, in order to ensure that the component of the invention has the same dimensions as the untreated workpiece, the thickness of the non-stratified oxide layer should be limited to 50 μm, in particular to 25 μm. Thus, the method of the invention allows that a component of a Group IV metal in its final shape is hardened without affecting its shape or dimension. This is especially relevant when grain growth is also undesirable and the first temperature is up to 700° C. The component to be treated is in its final shape. When a mirror polish appearance is intended, the component may be polished to provide a mirror polish appearance before treatment according the method of the invention, i.e. the surface has an Ra roughness of <0.1 μm. The method advantageously allows that the mirror polish appearance is also observed after treatment, i.e. the surface has an Ra roughness of <0.1 μm after treatment.

In the diffusion step oxygen from the non-stratified Group IV metal oxide is diffused into the Group IV metal, and the diffusion step can be performed independently of the parameters employed in the oxidation step. However, in order to prevent further oxidisation of the Group IV metal, the partial pressure of the gaseous oxidising species should be as low as possible. For example, the partial pressure of the gaseous oxidising species may be up to $10^{-4}$ mbar, although it is preferably lower, e.g. up to $10^{-5}$ mbar or up to $10^{-6}$ mbar.

The diffusion step may be performed in a vacuum. In the context of the invention, "vacuum" means that the pressure is up to $10^{-4}$ mbar although the composition of the atmosphere is not limited. In another embodiment, the diffusion step is performed in an inert atmosphere. In the context of the invention, an "inert atmosphere" is an atmosphere that does not contain components, except for unavoidable impurities, that will interact with the Group IV metal. A preferred inert atmosphere is a noble gas, e.g. argon. It is preferred to conduct the diffusion step in vacuum since this will more easily ensure that the hardened component retains its metallic lustre after being treated in the method of the invention. The present inventors have surprisingly observed that when the pressure in the diffusion step is above $10^{-4}$ mbar contaminants, including gaseous residuals, found in the oven, can prevent reformation of a metallic lustre on the component after treatment in the method of the invention.

The diffusion step is performed at a second temperature in the range of 500° C. to 800° C. over a diffusive duration of at least 0.1 hour, e.g. at least 1 hour. The diffusive duration should be sufficient to allow that the non-stratified oxide layer of the intermediary workpiece will be removed by allowing the oxygen atoms to diffuse into the Group IV metal. The diffusive duration does not have an upper limit. However, if the diffusive duration is extended excessively, the oxygen can eventually be distributed too evenly in the Group IV metal for the Group IV metal to have a diffusion zone providing a sufficient hardness. Thus, the diffusive duration should generally not be longer than 100 hours. The diffusive duration will depend on the thickness of non-stratified oxide layer, and the thicker the non-stratified oxide layer, the longer the diffusive duration for removal of the non-stratified oxide layer. The diffusive duration can therefore be considered to be determined by the choice of gaseous oxidising species, and also the first temperature and the oxidising duration. The diffusive duration is independent on the choice of Group IV metal.

In general, the higher the temperature the faster the diffusion, and since the gaseous oxidising species is not present to oxidise the workpiece the second temperature is less limited than the first temperature. It is therefore possible for the second temperature to be higher than the first temperature. Thus, when the second temperature is higher than the first temperature the hardening can be completed faster. In an embodiment, the second temperature is higher than the first temperature. In a further specific embodiment, the second temperature in the range of 600° C. to 750° C., e.g. 650° C. to 700° C. A second temperature of up to 700° C. can be selected when grain growth is undesirable, since a second temperature of up to 700° C. will prevent grain growth, and also deformation, of the Group IV metal. When the second temperature is in the range of 650° C. to 750° C., the diffusive duration will typically be in the range of 2 hours to 40 hours.

In a specific embodiment, the gaseous oxidising species is $CO_2$, the first temperature is in the range of 600° C. to 750° C., the oxidising duration is in the range of 1 hour to 8 hours, the second temperature is in the range of 650° C. to 750° C., and the diffusive duration is in the range of 2 to 8 times the oxidising duration, e.g. in the range of 2 hours to 64 hours. In another embodiment, the gaseous oxidising species is $CO_2$, the first temperature and the second temperature are both in the range of 650° C. to 700° C. with the second temperature being higher than the first temperature, the oxidising duration is in the range of 2 hours to 6 hours, and the diffusive duration is in the range of 3 to 6 times the oxidising duration, e.g. in the range of 6 hours to 36 hours.

In other embodiments, the gaseous oxidising species is $N_2O$ and/or $O_2$, the first temperature is in the range of 600° C. to 650° C., the oxidising duration is in the range of 30 minutes to 2 hours, the second temperature is in the range of 650° C. to 700° C., and the diffusive duration is in the range of 4 to 20 times the oxidising duration, e.g. in the range of 2 hours to 40 hours.

In a specific embodiment, the oxidising atmosphere further comprises CO. For example, the gaseous oxidising species may be $CO_2$ and the oxidising atmosphere may contain both CO and $CO_2$. The presence of carbon in the oxidising atmosphere will dissolve carbon in the Group IV metal, and carbon, even at trace levels, is believed to provide a more stable integration of the oxide layer with the diffusion zone between the core of the Group IV metal and the oxide layer, so that an extremely stable non-stratified oxide layer is formed. When the gaseous oxidising species is $CO_2$, without CO added to the oxidising atmosphere, a more stable non-stratified oxide layer is formed than when the oxidising is $O_2$ or $N_2O$. However, when $O_2$ or $N_2O$ is the gaseous oxidising species and the oxidising atmosphere is supplemented with CO, carbon will also be dissolved in the Group IV metal to afford a more stable non-stratified oxide layer. Other carbon containing molecules are also contemplated to dissolve carbon in the Group IV metal although hydrogen containing molecules, e.g. alkanes, should be avoided to prevent embrittlement of the Group IV metal.

When the oxidising atmosphere contains $CO_2$ and CO, $CO_2$ and CO will take part in Reaction 1 and Reaction 2 identified below.

$$CO(g)+\tfrac{1}{2}O_2(g)=CO_2(g) \qquad \text{Reaction 1}$$

$$2CO(g)=CO_2(g)+C \qquad \text{Reaction 2}$$

In general, CO is considered to be a carbon providing molecule without oxidising capability, whereas $CO_2$ has an oxidising potential but limiting carbon activity. The partial pressure of $O_2$ ($pO_2$) and the activity of carbon ($a_c$) existing from Reaction 1 and Reaction 2 can be determined from Equation 1 and Equation 2. Thus, the partial pressure of $O_2$ is:

$$pO_2 = \left(\frac{pCO_2}{pCO}\right)^2 \exp\left(\frac{2\Delta G_1}{RT}\right) \qquad \text{Equation 1}$$

and the activity of carbon is:

$$a_C = \left(\frac{pCO}{pCO_2}\right)^2 \exp\left(\frac{-\Delta G_2}{RT}\right) \qquad \text{Equation 2}$$

where $\Delta G_1=-282.200+86.7\ T$ (J), and $\Delta G_2=-170.550+174.3\ T$ (J).

By using a mixture of $CO_2$ and CO, the amount of carbon dissolved into the Group IV metal can be controlled, and it is therefore possible to tailor the oxidising atmosphere to eventually also tailor the diffusion zone of the component of the invention. Carbon will generally increase the microhardness of the diffusion zone compared to a diffusion zone comprising oxygen but no carbon. Furthermore, CO is believed to provide a thicker diffusion zone together with a thinner oxide layer. The combination of the thinner oxide layer and thicker diffusion zone is considered advantageous in the subsequent the step of diffusing oxygen from the non-stratified Group IV metal oxide into the Group IV metal, since the oxygen atoms in the Group IV metal oxide will diffuse more efficiently into the Group IV metal. Moreover, without being bound by theory the present inventors believe that carbon in the Group IV metal oxide will further stabilise the non-stratified oxide layer thereby yielding an improved process compared to using only $CO_2$, $O_2$ or $N_2O$ as the gaseous oxidising species. In a specific embodiment, the oxidising atmosphere therefore has a mixture of $CO_2$ and CO with 40% to 90% $CO_2$ compared to the total of $CO_2$ and CO. In another embodiment, the oxidising atmosphere has a mixture of $CO_2$ and CO with 40% to 60% $CO_2$ compared to the total of $CO_2$ and CO. Similar ratios are relevant for other gaseous oxidising species, e.g. $O_2$ or $N_2O$. For example, the oxidising atmosphere may have a mixture of $O_2$ and CO with 40% to 60% $O_2$ compared to the total of $O_2$ and CO. The oxidising atmosphere may also have a mixture of $N_2O$ and CO with 40% to 60% $N_2O$ compared to the total of $N_2O$ and CO.

Treatment of the Group IV metal in the oxidising atmosphere will dissolve oxygen into the Group IV metal so that a diffusion zone is formed between the core of the Group IV metal and the non-stratified oxide layer. In the context of the invention, a "diffusion zone" is any zone, e.g. identified from the surface of the Group IV metal to a depth in the Group IV metal, where oxygen is dissolved in the Group IV metal. Interstitial oxygen will harden the Group IV metal, and the diffusion zone can therefore be identified by measuring the hardness in the cross-section of the Group IV metal. After the diffusion step, the oxygen atoms from the non-stratified oxide layer have diffused into the Group IV metal so that only the unavoidable nanometer thickness oxide layer is present on the Group IV metal. The concentration of the interstitial oxygen will be highest at the surface of the hardened Group IV metal to decrease at increasing depth. In general, the diffusion zone is considered to extend from the surface of the Group IV metal to a depth where the cross-sectional hardness is at 120% of the hardness of the core of the Group IV metal.

It is preferred that the concentration of interstitial oxygen near the surface of the Group IV metal is close to saturation. A surface hardness of 1000 $HV_{0.025}$ is available for any Group IV metal even though the oxygen content near the surface is lower than the saturation level for oxygen. A surface hardness of 650 $HV_{0.025}$ is considered sufficient to provide scratch resistance to the hardened Group IV metal. A thickness of the diffusion zone of about 5 μm will allow that a surface hardness of 1000 $HV_{0.025}$ is obtained. Thus, in a preferred embodiment, the diffusion zone has a thickness of at least 5 μm. The thickness of the diffusion zone is not limited although when the thickness if above 50 μm, no effect is observed for the increased thickness. Thus, in an embodiment the diffusion zone has a thickness in the range of 5 μm to 50 μm, i.e. a hardness of 120% of the core hardness of the Group IV metal can be recorded at a depth of 50 μm from the surface. The cross-section and the corresponding hardness profile of a hardened Grade 4 titanium is shown in FIG. 3; the core hardness is about 230 HV, and a hardness of about 280 HV is observed at a depth from the surface of 0.06 mm, so that the diffusion zone has a thickness of 60 μm.

Removal of the non-stratified oxide layer is easily detected visually, by analysis of the cross-section, or by GDOES analysis. Visual inspection of the surface of the component will show if the component has a metallic lustre of if an oxide layer is present on the surface. Exemplary components are shown in FIG. 4 and FIG. 6 for titanium of Grade 2 and 23, respectively. The corresponding cross-sections for FIG. 4 are shown in FIG. 5. In FIG. 4 to FIG. 6 (*a*) shows the untreated workpiece, (*b*) shows the intermediary workpiece, and (*c*) shows the component of the invention.

Exemplary GDOES analyses are shown in FIG. 9 and FIG. 10 for Grade 2 titanium and FIG. 12 and FIG. 13 for Grade 5 titanium, respectively, with the oxide layer and after removal of the oxide layer, respectively. The intermediary workpiece has a stable content of oxygen at a depth from the surface, which indicates the presence of an oxide layer. In contrast, the final component will show a decreasing amount of oxygen from the surface, thus illustrating the diffusion zone.

When carbon is present in the oxidising atmosphere, e.g. when the gaseous oxidising species is $CO_2$, or when the oxidising atmosphere is supplemented with CO, carbon will be present in the non-stratified oxide layer. Likewise, when nitrogen is present, e.g. as $N_2$ or $N_2O$, nitrogen will be present in the non-stratified oxide layer. The carbon content and/or the nitrogen content is/are detectable using GDOES, as evident from FIG. 9 and FIG. 12. When oxygen is diffused into the Group IV metal in the diffusion step, carbon will also diffuse into the Group IV metal. However, the carbon atoms will distribute differently than the oxygen atoms so that, as it is detectable with GDOES analysis, the intensity for carbon will show a peak, i.e. a local maximum in the intensity, in the diffusion zone. Likewise, the intensity for nitrogen may show a peak, i.e. a local maximum in the intensity, in the diffusion zone. Without being bound by theory, the present inventors believe that the local maximum in carbon intensity represents a peak in the concentration of interstitial carbon in the diffusion zone, which in turn increases the hardness of the diffusion zone at the corresponding location. Further without being bound by theory, the present inventors believe that this peak in carbon concentration is also reflected in the surface hardness of the component of the invention. The same considerations are relevant for the nitrogen peak in the diffusion zone when present. Thereby, hardening using $CO_2$ as the gaseous oxidising species or when the oxidising atmosphere is supplemented with CO provide a higher surface hardness than available using non-carbon containing gaseous oxidising species. For example, a surface hardness of Grade 5 titanium of about 1300 $HV_{0.025}$ compared to a surface hardness of the untreated metal of about 460 $HV_{0.025}$ was obtained using $CO_2$ as the gaseous oxidising species. For Grade 2 titanium a surface hardness of about 1100 $HV_{0.025}$ compared a surface hardness of the untreated metal of about 360 $HV_{0.025}$ was obtained using $CO_2$ as the gaseous oxidising species. In a specific embodiment, the component is a Grade 5 titanium and has a surface hardness of at least 1300 $HV_{0.025}$. In another embodiment, the component is a Grade 2 titanium and has a surface hardness of at least 1100 $HV_{0.025}$.

The local maximum in the carbon intensity is also relevant when the oxidising atmosphere contains CO, and in this case the higher carbon activity will provide an even harder diffusion zone and also harder surface. Thus, when the oxidising atmosphere has a mixture of $CO_2$ and CO with 40% to 60% $CO_2$ compared to the total of $CO_2$ and CO, when the oxidising atmosphere has a mixture of $O_2$ and CO with 40% to 60% $O_2$ compared to the total of $O_2$ and CO, or when the oxidising atmosphere has a mixture of $N_2O$ and CO with 40% to 60% $N_2O$ compared to the total of $N_2O$ and CO, a surface hardness of at least 800 $HV_{0.025}$ is available for Grade 5 titanium, and a surface hardness of at least 800 $HV_{0.025}$ is available for Grade 2 titanium.

In general, all variations and features for any aspect and embodiment of the invention may be combined freely. The features described above for the method are thus equally relevant for the component of the invention.

BRIEF DESCRIPTION OF THE FIGURES

In the following the invention will be explained in greater detail with the aid of an example and with reference to the schematic drawings, in which.

Figure 1:
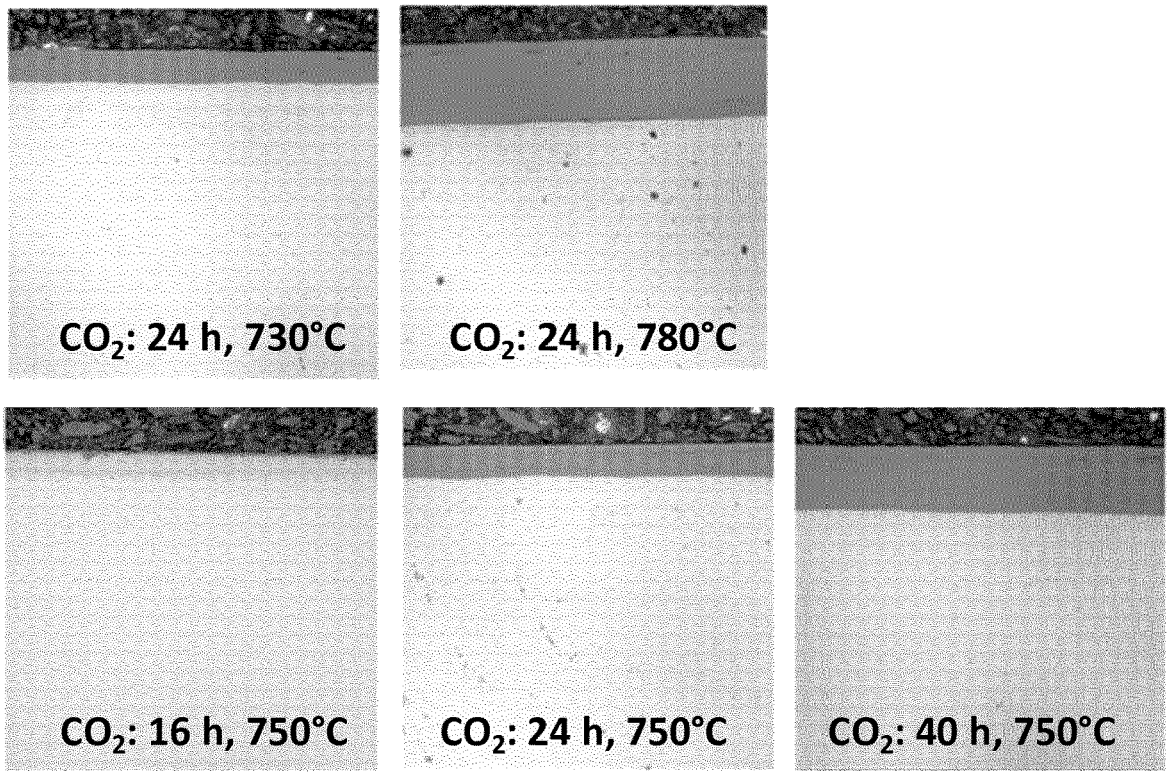
FIG. 1 shows oxide layers from treatment with $CO_2$.

Reference to the figures serves to explain the invention and should not be construed as limiting the features to the specific embodiments as depicted.

DETAILED DESCRIPTION OF THE INVENTION

The present invention relates to a method of oxygen hardening a Group IV metal and to a Group IV metal component having a surface hardness of at least 200 $HV_{0.025}$ higher than the core hardness.

In the context of the invention "Group IV metal" is any metal selected from the titanium group of the periodic table of the elements or an alloy comprising at least 50% of metals from the titanium group. Thus, a "titanium alloy" is any alloy containing at least 50% (a/a) titanium, and likewise a "zirconium alloy" is any alloy containing at least 50% (a/a) zirconium. It is contemplated that for the method of the invention and for the component of the invention any alloy containing a sum of titanium and zirconium of at least 50% (a/a) is appropriate. Likewise, the alloy may also comprise hafnium, which is a member of Group IV of the periodic table of the elements so that any alloy having a sum of titanium, zirconium, and hafnium of at least 50% (a/a) is appropriate for the invention.

Alloys of relevance to the invention may contain any other appropriate element, and in the context of the invention an "alloying element" may refer to a metallic component or element in the alloy, or any constituent in the alloy. Titanium and zirconium alloys are well-known to the skilled person. Alloys of Group IV metals may also comprise metals from other groups of the periodic table of the elements, e.g. aluminium or niobium. An exemplary niobium containing alloy is Ti13Nb13Zr. Aluminium containing alloys are Ti6Al4V (Grade 5), which exists as an "extra low interstitial" (ELI) version, Ti6Al4V ELI that is commonly referred to as Grade 23.

Any grade of titanium containing at least about 99% (w/w) titanium is, in the context of the invention, considered to be "pure titanium", e.g. Grade 1 titanium, Grade 2 or Grade 4 titanium; thus, the pure titanium may contain up to about 1% (w/w) trace elements, e.g. oxygen, carbon, nitrogen or other metals, such as iron. Pure titanium may also be referred to as "commercially pure" (CP). In particular, nitrogen and carbon contained in a Group IV metal in the context of the invention may represent unavoidable impurities. Elements present as "unavoidable impurities" are considered not to provide an effect for a workpiece treated according to the method of the invention or for the component of the invention. Likewise, any grade of zirconium containing at least about 99% (w/w) zirconium is, in the context of the invention, considered to be "pure zirconium".

When a percentage is stated for a metal or an alloy the percentage is by weight of the weight of material, e.g. denoted % (w/w), unless otherwise noted. When a percentage is stated for an atmosphere the percentage is by volume, e.g. denoted % (v/v), unless otherwise noted. Likewise, unless otherwise noted a composition of a mixture of gasses may be on an atomic basis and may then be provided as a percentage or in ppm (parts per million).

In the context of the invention the hardness is generally the $HV_{0.025}$ as measured according to the DIN EN ISO 6507 standard. If not otherwise mentioned the unit "HV" thus refers to this standard. The hardness may be recorded for a cross-section, e.g. of a treated Group IV metal, and it may be noted with respect to the depth of the measurement. The hardness measurement in the cross-section may also be referred to as "microhardness", and the hardness measurement at the surface may also be referred to as "macrohardness".

The microhardness measurement is generally independent of the testing conditions, since the measurement is performed at microscale in the cross-section. Microhardness measurements are typically performed at a load of 25 g, i.e. $HV_{0.025}$, or 50 g, i.e. $HV_{0.05}$. In contrast, the macrohardness may be performed from the surface with a much higher load, e.g. 0.50 kg, corresponding to $HV_{0.5}$, so that the measurement represents an overall value of the hardness of the respective material and whatever surface layers it contains. Microhardness measurements at loads of 25 g or 50 g typically provide the same value, "HV", but measurement at 25 g is preferred since the measurement requires less space in the cross-section.

When the hardness is recorded at a cross-section the measurement is considered to represent a homogeneous sample with respect to the direction of the pressure applied. In contrast, when the hardness is obtained from measurements at the surface the measurement may represent an average of several different values of hardness, i.e. at different depths. Thus, when the surface hardness is measured at a high load, e.g. 0.50 kg, the value can be considered to provide an "average" value for both the surface and also depths below the surface. It is therefore preferred that surface hardness is measured with a load of 25 g or 50 g. When the surface hardness is measured with a load of 25 g, a value of 650 $HV_{0.025}$ is considered to show that the material is scratch resistant. As an effect of the fact that oxygen is dissolved from the surface the content of dissolved oxygen will decrease from the surface towards the core of the Group IV metal, and likewise, the hardness will be maximal at the surface.

EXAMPLES

Example 1

Specimens of CP Grade 4 titanium were provided and treated in a Netzsch STA449 C (furnace) using $CO_2$ or a Netzsch STA449 F3 (furnace) using $N_2O$ as the gaseous oxidising species at ambient pressure at different first temperatures and oxidising durations. Following the oxidising treatments, the cross-sections of the treated samples were analysed microscopically. Thus, FIG. 1 shows how $CO_2$ as the gaseous oxidising species provides stable non-stratified oxide layers at any temperature and duration tested where the temperature and duration are indicated in FIG. 1. As expected the thickness increased with increasing oxidising duration. FIG. 1 thus shows that $CO_2$ as the gaseous oxidising species provides a robust process allowing formation of the non-stratified oxide layer at the lowest temperature tested, 730° C.

Figure 2:
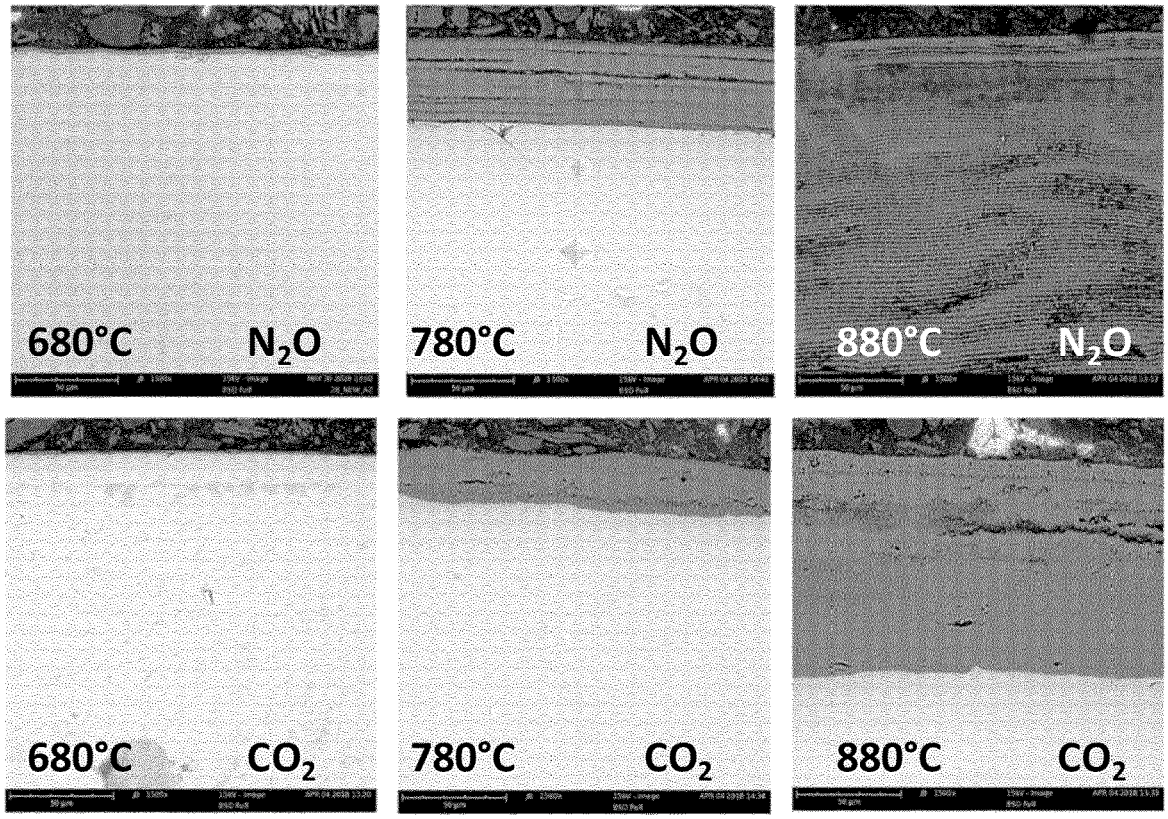
FIG. 2 shows oxide layers from treatment with $N_2O$ and $CO_2$.

In FIG. 2 the cross-sections of oxide layers provided using $CO_2$ or $N_2O$ as the gaseous oxidising species are compared. The oxidising durations were 16 hours. FIG. 2 shows that at a temperature of 880° C., $CO_2$ provided a thick and stable non-stratified oxide layer, which illustrates the robustness of using $CO_2$ as the gaseous oxidising species. In contrast, treatment with $N_2O$ as the gaseous oxidising species resulted in formation of stratified oxide layers at 780° C. and higher. These stratified oxide layers can be remove easily using even a finger nail and are not appropriate for diffusing oxygen into the titanium. However, at 680° C. as the oxidising temperature, both $N_2O$ and $CO_2$ provided non-stratified oxide layers, e.g. of about 5 μm thickness, appropriate for treatment in the diffusion step.

Example 2

Figure 3:
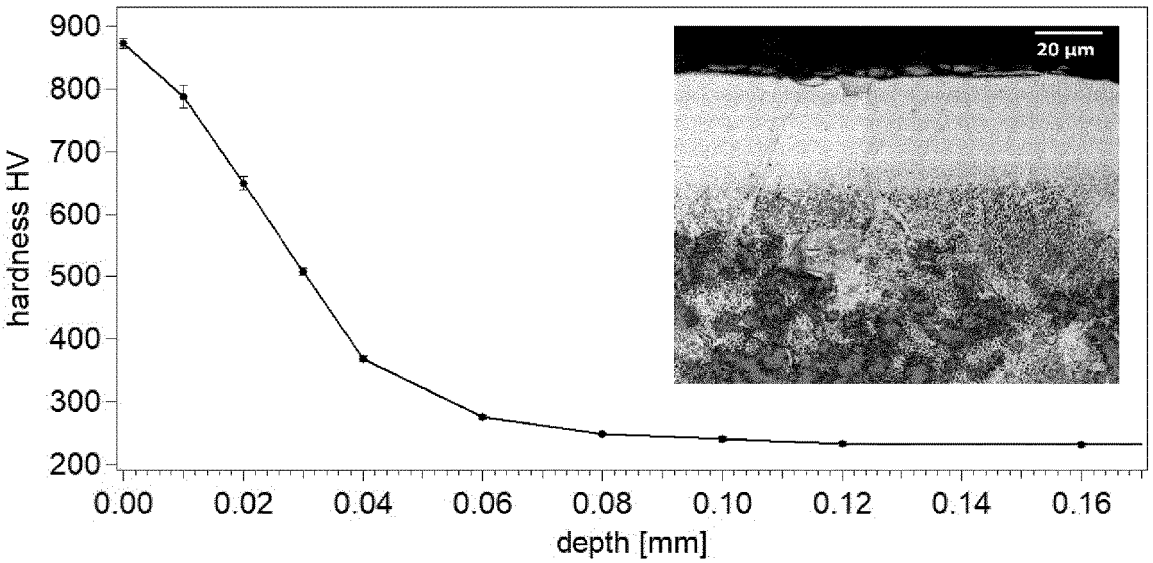
FIG. 3 shows a hardness profile and the cross-section of a titanium component of the invention.

A sample of Grade 4 titanium was treated with $N_2O$ for 64 minutes at ambient pressure at 600° C. This oxidising step was followed by the diffusion step conducted in vacuum at about $10^{-6}$ mbar at 750° C. for 4 hours. The treatment provided the sample with an unaffected surface finish so that the sample regained its metallic lustre. The cross-section of the hardened sample was analysed microscopically, and the hardness profile measured. The results are shown in FIG. 3. The Grade 4 titanium had a core hardness of about 230 $HV_{0.025}$, and a hardness of about 280 $HV_{0.025}$ was observed at a depth from the surface of 0.06 mm, so that the diffusion zone has a thickness of 60 μm.

Example 3

Workpieces with diameters of 15 mm and thicknesses of 2 mm of CP titanium (Grade 2) and Ti6Al4V ELI were treated in two separate steps.

In the first step, the oxidising step, a sample was placed in a MTI OFT-1200 glass tube furnace. The furnace was evacuated and backfilled with $CO_2$. A continuous gas flow of 200 ml/min was used. The workpiece was heated to 650° C. at a rate of 12 K/m in. The furnace was kept at 650° C. for 4 hours after which the furnace was allowed to cool down to room temperature unaided.

In the second step, the diffusion step, the cooled workpiece from the first step was placed in a tube furnace with an Edwards 85 T-station turbo vacuum pump. The vacuum pump was allowed to evacuate the chamber to $<10^{-3}$ mbar before the furnace was turned on. The furnace heats at a rate of approx. 50 K/min (>250° C.). The furnace was kept at 680° C. for 16 hours after which the furnace was cooled down to room temperature at a rate of approx. 25 K/min. The end pressure in the furnace chamber was $<10^{-4}$ mbar.

Figure 4:
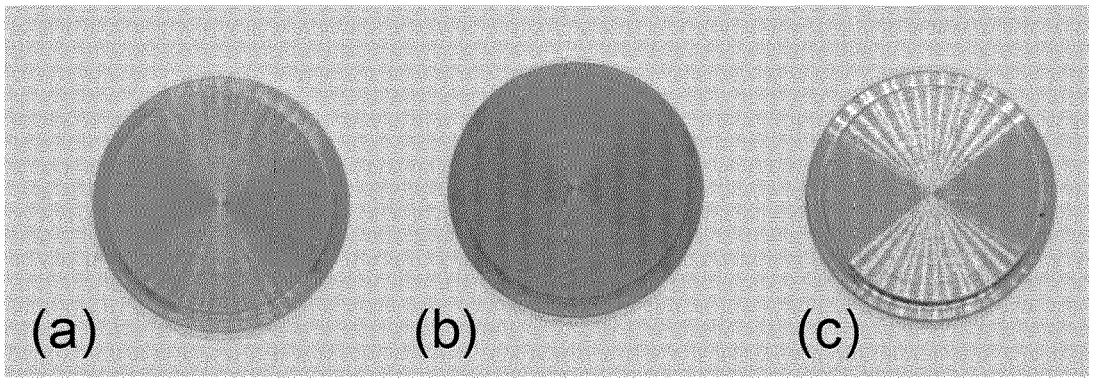
FIG. 4 shows an untreated workpiece, an intermediary component and hardened component.
Figure 6:
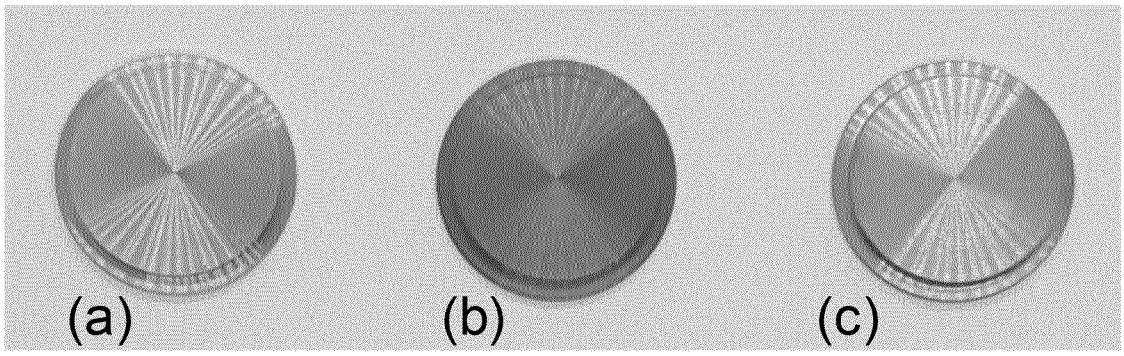
FIG. 6 shows an untreated workpiece, an intermediary component and hardened component.

Photos of the components are shown in FIG. 4 (Grade 2) and FIG. 6 (Ti6Al4V ELI), where (a) shows the untreated workpiece, (b) shows the intermediary workpiece, and (c) shows the component of the invention. The oxided surface is clearly visible for the intermediary workpieces (b), whereas the components (c) have regained the metallic lustre.

Figure 5:
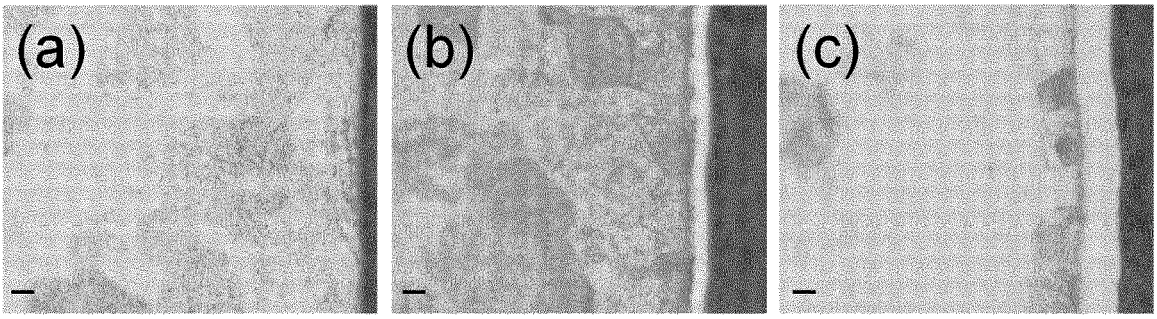
FIG. 5 shows cross-sections of an untreated workpiece, an intermediary component and hardened component.
Figure 7:
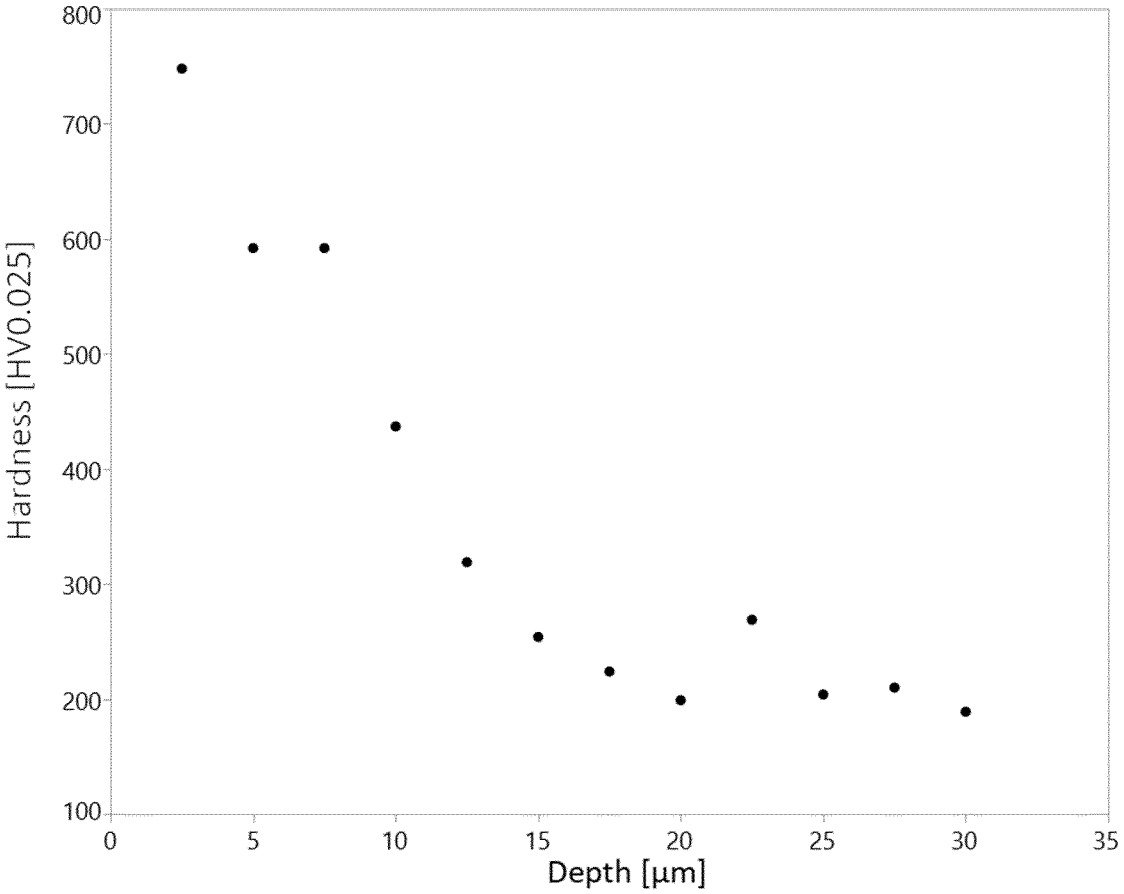
FIG. 7 shows a hardness profile a titanium component of the invention.

The cross-sections of (a), (b) and (c) of FIG. 4 (Grade 2) are shown in FIG. 5, where the black bars correspond to 5 μm. Thus, the non-stratified oxide layer had a thickness of about 2 μm, which provided a diffusion zone with a thickness in excess of 5 μm. The cross-sectional hardness of the component of Ti6Al4V ELI is shown in FIG. 7, which shows that the diffusion zone had a thickness of about 15 μm. The untreated Grade 2 had a surface hardness of about 361 $HV_{0.025}$, and the untreated Ti6Al4V ELI had a surface hardness of about 450 $HV_{0.025}$. After the hardening, the surface hardnesses were 1152 $HV_{0.025}$ and 1382 $HV_{0.025}$, respectively.

Example 4

Figure 8:
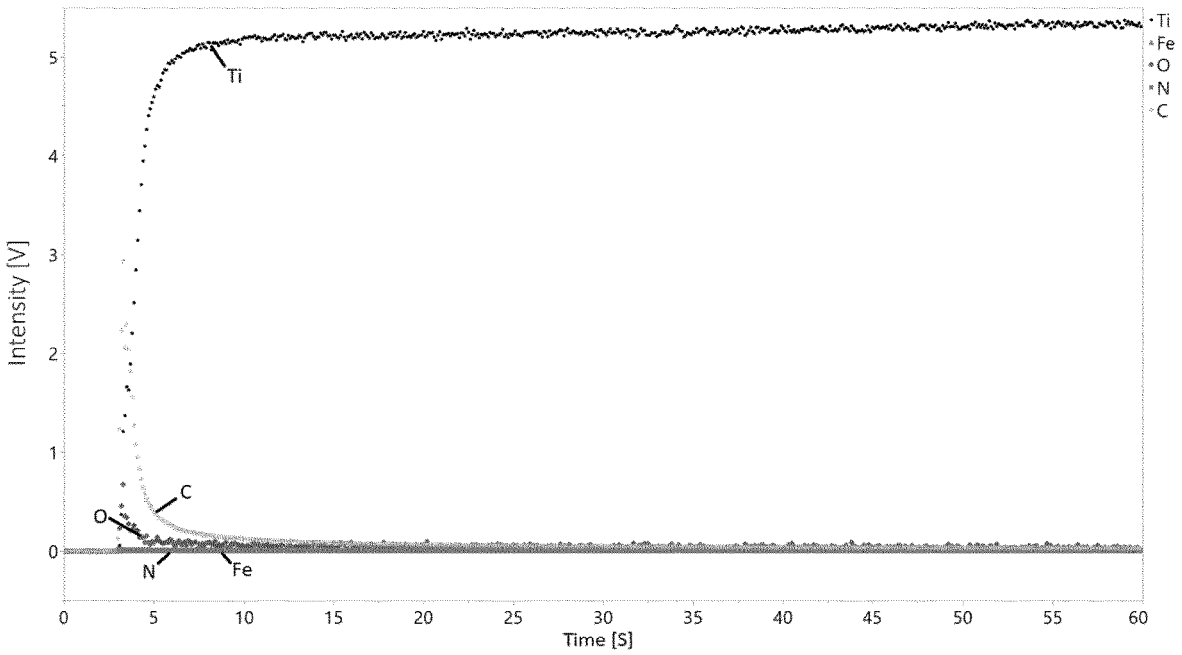
FIG. 8 shows a Glow Discharge Optical Emission Spectroscopy (GDOES) curve for an untreated titanium workpiece.
Figure 9:
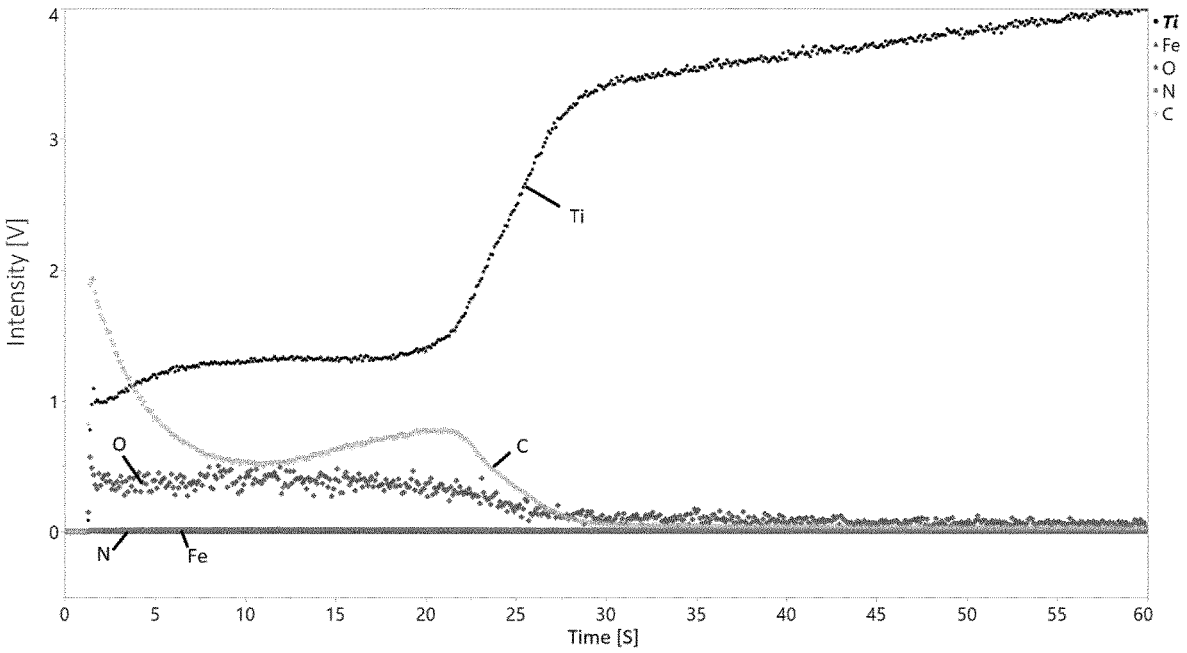
FIG. 9 shows a GDOES curve for an intermediary titanium component.
Figure 10:
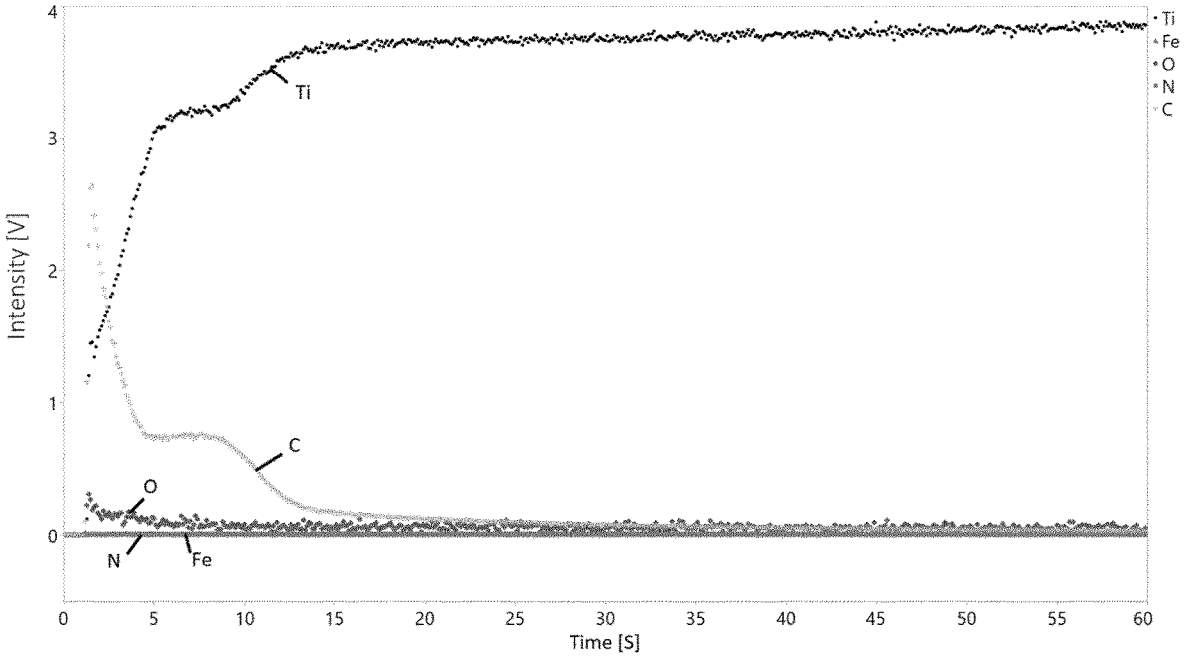
FIG. 10 shows a GDOES curve for a titanium component of the invention.
Figure 11:
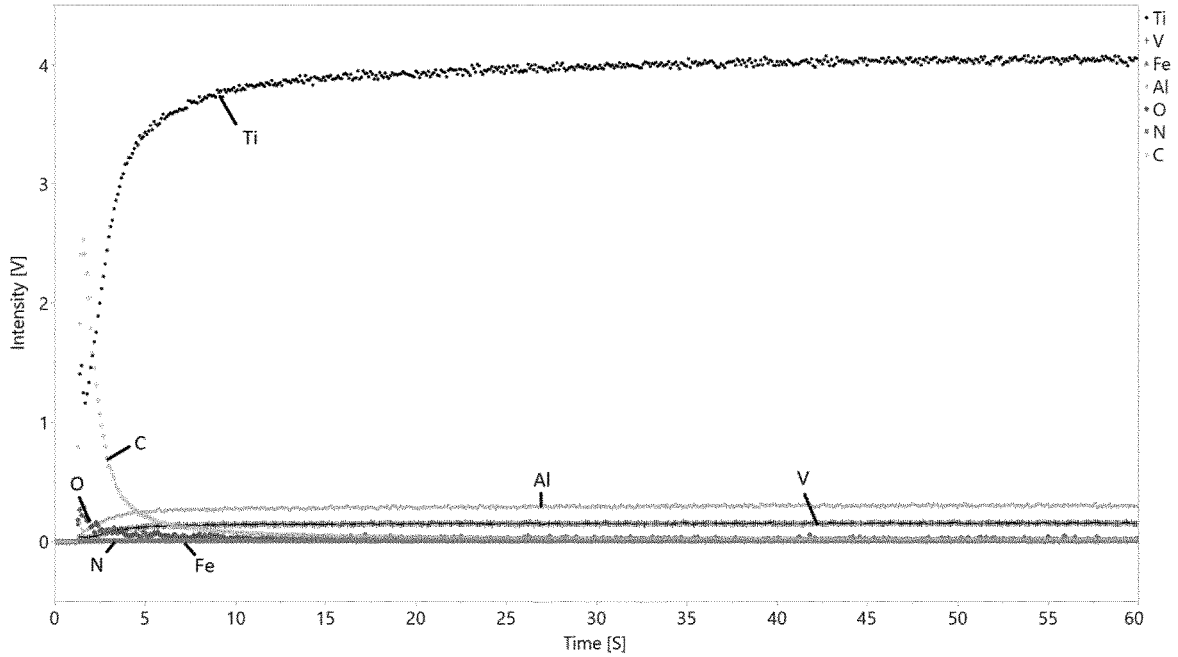
FIG. 11 shows a GDOES curve for an untreated titanium workpiece.
Figure 12:
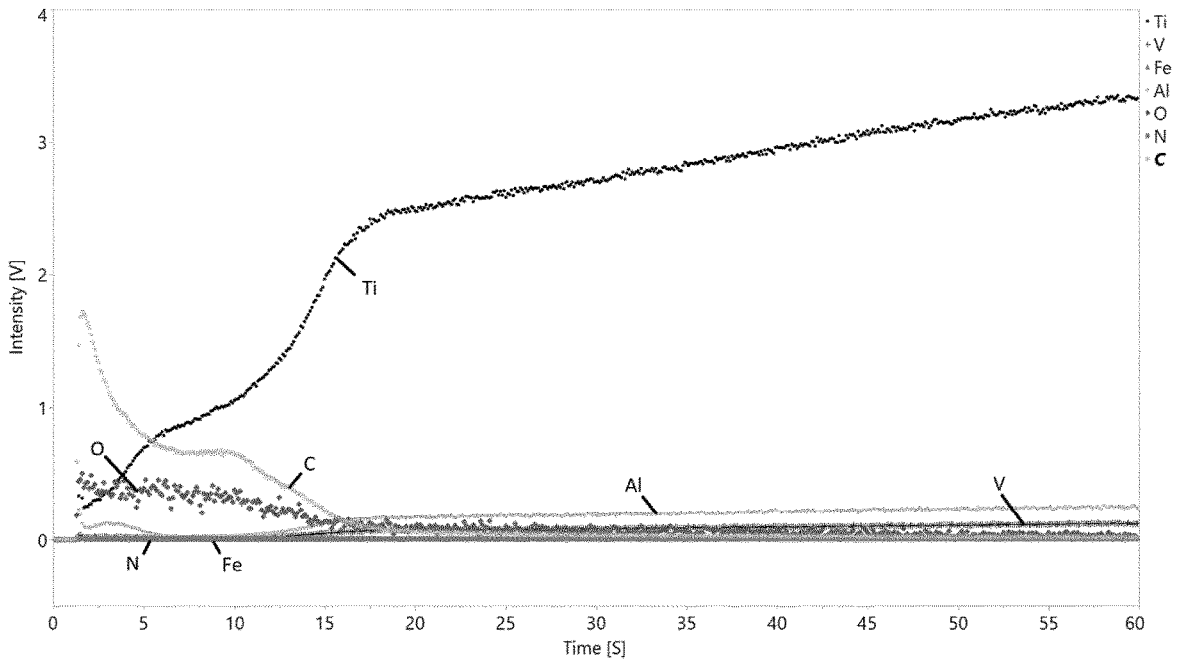
FIG. 12 shows a GDOES curve for an intermediary titanium component.
Figure 13:
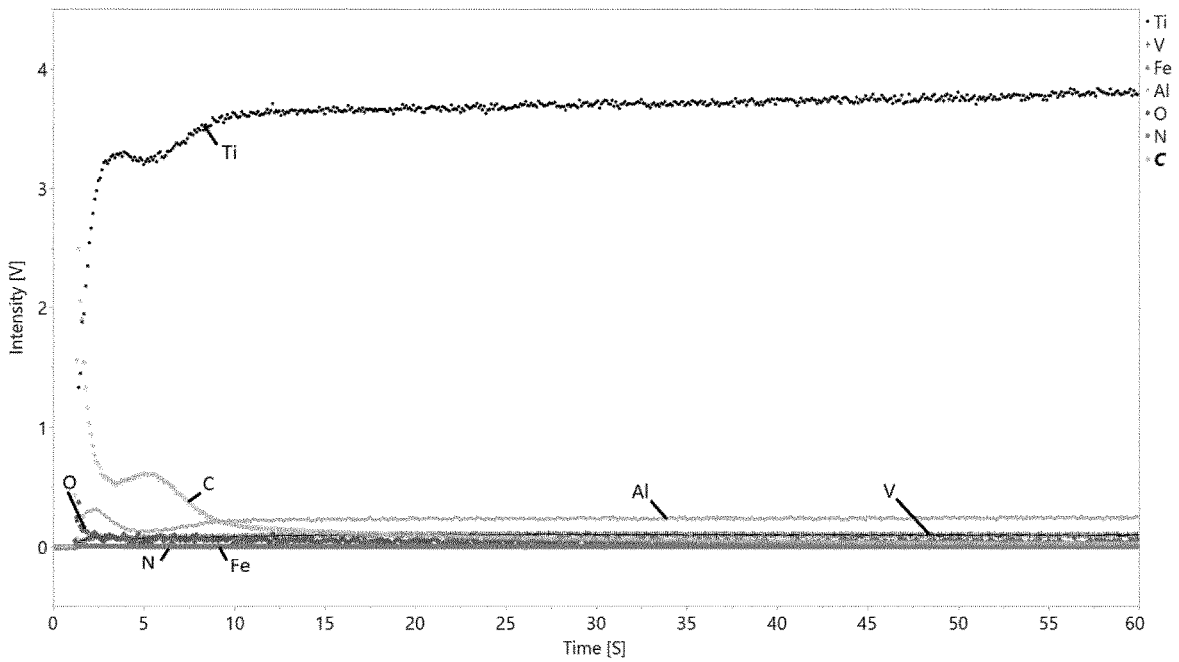
FIG. 13 shows a GDOES curve for a titanium component of the invention.

The samples of Example 3 were further analysed using Glow Discharge Optical Emission Spectroscopy (GDOES) analysis, and the results are shown in FIG. 8 to FIG. 13. Thus, FIG. 8 shows the GDOES analysis for the untreated Grade 2 titanium workpiece, FIG. 9 shows the GDOES analysis for the intermediary Grade 2 titanium workpiece, and FIG. 10 shows the GDOES analysis for the Grade 2 titanium component of the invention. Likewise, FIG. 11 shows the GDOES analysis for the untreated Ti6Al4V ELI workpiece, FIG. 12 shows the GDOES analysis for the intermediary Ti6Al4V ELI workpiece, and FIG. 13 shows the GDOES analysis for the Ti6Al4V ELI component of the invention.

The GDOES analyses the content of specified elements shown as an intensity (in the unit V) over time (in second). Thus, the intensity reflects the relative amount of the element and the time reflects the depth from the surface. By analysing the sample for a sufficient time to reflect the composition of layers relevant for the workpiece or component, the GDOES analysis appropriately provides a comparison of the compositions of the untreated workpiece, the intermediary workpiece having the non-stratified oxide layer and the diffusion zone between the non-stratified oxide layer and the material core, and the core of the Group IV metal.

Thus, FIG. 8 and FIG. 11 illustrate how the composition of the metal is generally stable over the thickness. FIG. 9 and FIG. 12 show an approximately stable amount of oxygen, which represents the non-stratified oxide layer, which at higher values of time changes to a gradually increasing titanium signal with a correspondingly decreasing oxygen signal, which together represent the diffusion zone. At higher values for time the oxygen signal stabilises thus representing the core of the Group IV metal. Since $CO_2$ was used as the gaseous oxidising species carbon is also present in both the non-stratified Group IV metal oxide and also in the diffusion zone below the non-stratified metal oxide layer. FIG. 10 and FIG. 13 show the final components of Grade 2 titanium and Ti6Al4V ELI, respectively. The carbon signal shows that the carbon intensity increases from the surface, which is visible as a local maximum in the intensity curve for carbon. This local maximum is considered to represent a peak in the concentration of interstitial carbon in the diffusion zone after removal of the non-stratified metal oxide layer, and it is further considered to increase the hardness beyond the hardness available had the carbon not been present.

Example 5

A workpiece of Ti6Al4V (Grade 5) was treated to provide a component of the invention. Specifically, the workpiece was created by 3D printing as a cylindrical workpiece with a diameter of 12 mm and a height of 15 mm, and the workpiece was subsequently treated in two separate steps.

In the first step, the sample was placed in a MTI OFT-1200 glass tube furnace, which was evacuated and backfilled with $CO_2$. A continuous gas flow of 200 ml/min was used. The workpiece was heated to 650° C. at a rate of 12 K/min. The furnace was kept at 650° C. for 4 hours after which the furnace was allowed to cool down to room temperature unaided.

Figure 14:
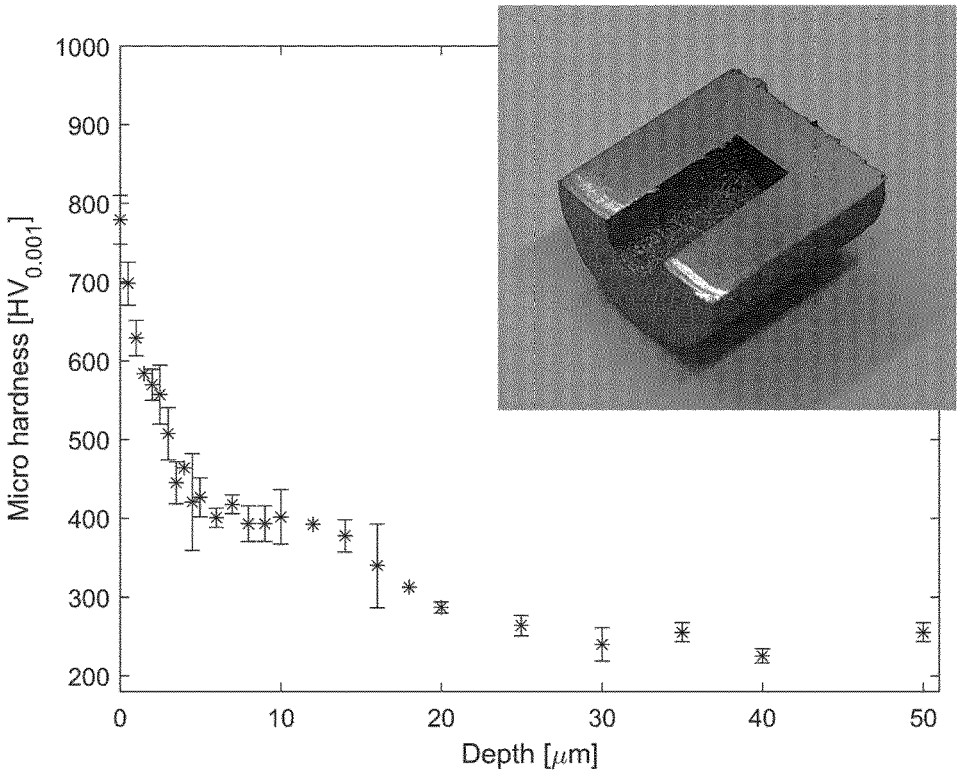
FIG. 14 shows a hardness profile and the cross-section of a titanium component of the invention.

In the second step, the diffusion step, the cooled workpiece from the first step was placed in a tube furnace with an Edwards 85 T-station turbo vacuum pump. The vacuum pump was allowed to evacuate the chamber to $<10^{-3}$ mbar before the furnace was turned on. The furnace heats at a rate of approx. 50 K/min (>250° C.). The furnace was kept at 680° C. for 16 hours after which the furnace was cooled down to room temperature at a rate of approx. 25 K/min. The end pressure in the furnace chamber was $<10^{-4}$ mbar. A photo and the hardness profile of the component are illustrated in FIG. 14. The component showed an increased hardness at a depth of up to 20 μm. The hardness profile is similar to the one seen on a non-3D printed Ti6Al4V component.

Example 6

Workpieces with a diameter of 15 mm and a thickness of 2 mm were treated in two separate steps in a variant where CO was included in the oxidising atmosphere. The sample were of CP titanium of Grade 4 and Ti6Al4V (Grade 5).

In the first step, a sample was placed in a MTI OFT-1200 glass tube furnace. The furnace was evacuated and backfilled with $CO_2$/CO at a 50/50 ratio using a continuous gas flow of 200 ml/min. The workpiece was heated to 650° C. at a rate of 12 K/min. The furnace was kept at 650° C. for 4 hours after which the furnace was allowed to cool down to room temperature unaided.

In the second step, the cooled workpiece from the first step was placed in a tube furnace with an Edwards 85 T-station turbo vacuum pump. The vacuum pump was allowed to evacuate the chamber to $<10^{-3}$ mbar before the furnace was turned on. The furnace heats at a rate of approx. 50 K/min (>250° C.). The furnace was kept at 680° C. for 16 hours after which the furnace was cooled down to room temperature at a rate of approx. 25 K/m in. The end pressure in the furnace chamber was $<10^{-4}$ mbar.

The provided component showed a similar surface to the one seen on the component oxidised only in $CO_2$, and the components thus provided regained their metallic lustre after the diffusion step.

Example 7

Samples of CP titanium of Grade 4 and Ti6Al4V (Grade 5) with a diameter of 15 mm and a thickness of 2 mm were treated in a variant where ambient air at ambient pressure was used as the oxidising atmosphere.

In the first step, the sample was placed in a Nabertherm LE4/11 R6 furnace, and the sample was then heated to 650° C. at a rate of 12 K/m in. The furnace was kept at 650° C. for 4 hours after which the furnace was allowed to cool down to room temperature unaided.

In the second step, the cooled sample from the first step was placed in a tube furnace with an Edwards 85 T-station turbo vacuum pump. The vacuum pump was allowed to evacuate the chamber to $<10^{-3}$ mbar before the furnace was turned on. The furnace heats at a rate of approx. 50 K/m in (>250° C.). The furnace was kept at 680° C. for 16 hours after which the furnace was cooled down to room temperature at a rate of approx. 25 K/m in. The end pressure in the furnace chamber was $<10^{-4}$ mbar.

The components included interstitial nitrogen, which was reflected as a higher surface hardness. The Grade 4 titanium component had a surface similar to the one seen on the component oxidised only in $CO_2$, whereas the Grade 5 titanium component was less aesthetically pleasing.

Example 8

Samples of zirconium (Zr702) and a niobium containing alloy (Ti13Nb13Zr) were treated using $CO_2$ as gaseous oxidising species at 650° C. for 4 hours followed by the diffusion step in vacuum for 16 hours at 680° C. as described in Example 3. The Ti13Nb13Zr workpiece had a diameter of 10 mm and a thickness of 1 mm, whereas the Zr702 workpiece was a square with a side length of 15 mm and a thickness of 1.5 mm.

The treatment resulted in surface hardnesses of the components of about 860 $HV_{0.025}$ and about 1218 $HV_{0.025}$, respectively for the Ti13Nb13Zr and the Zr702, compared to surface hardnesses of the workpieces of 264 $HV_{0.025}$ and 185 $HV_{0.025}$, respectively, before treatment.

Example 9

A workpiece with a diameter of 15 mm and a thickness of 2 mm was treated in the two steps outlined in Example 3 followed by an additional anodisation step. The workpiece was of CP titanium grade 4.

In the third step, the anodisation step, the component was cleaned in first distilled water, followed by ethanol and then turpentine. The component was lowered into a solution containing 15% phosphoric acid. A voltage of 70 V was applied for 5 to 10 seconds. After the diffusion step, the component regained its metallic lustre, but the anodisation provide a visible oxide layer typical of anodised titanium that has not been treated in the method of the invention.

Example 10

Experiment were conducted to define the limits for formation of stratified titanium oxide layers vs. non-stratified titanium oxide layers when using $N_2O$ as the gaseous oxidising species. Specifically, specimens of CP Grade 2 titanium were provided and treated as done in Example 1.

Figure 15:
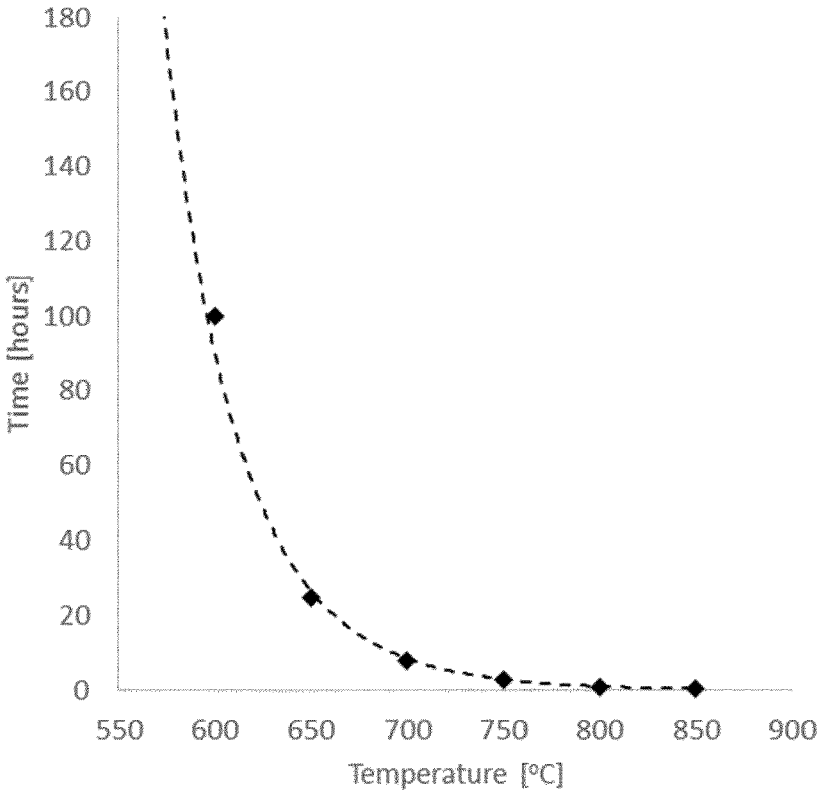
FIG. 15 shows a plot of time vs. temperature for the provision of non-stratified titanium oxide layers.

Following the oxidising treatments, the cross-sections of the treated samples were analysed microscopically, and the results are plotted in FIG. 15. Thus, FIG. 15 is a plot of time vs. temperature, and the markers show the limits, so that the "area" below the dotted line is the region where a non-stratified titanium oxide layer will form when $N_2O$ is used as the gaseous oxidising species. For example, for $N_2O$ as the gaseous oxidising species treatment at a temperature in the range of 500° C. to 700° C. with an oxidising duration in the range of 10 minutes to 2 hours, or a temperature in the range of 550° C. to 600° C. with an oxidising duration in the range of 30 minutes to 2 hours will yield a non-stratified oxide layer of a sufficient thickness to subsequently harden the titanium in the diffusion step.

Example 11

A CP Titanium 030 mm disc with a thickness of 15 mm was polished to a mirror like surface finish. Prior to treatment the CP titanium specimen was polished to a mirror polished surface finish, i.e. having an arithmetical mean deviation (Ra) roughness of <0.1 μm (thus being in accordance with the ISO 1302:2002 standard). The Ra value was measured using a Taylor-Hubson Surtronic S25 measuring over a length of 1.25 mm. The measurement was repeated 12 times on the surface of the specimen. The mean Ra value was measured to <0.1 μm, and the surface of the specimen was approved as mirror polished.

The specimen was placed in a Nabertherm 3-Zone furnace. The furnace was evacuated and backfilled using $CO_2$ twice. The furnace was then heated to 650° C. for 4 hours using a continuous flow of $CO_2$ at 500 ml/min. The furnace was allowed to cool down using furnace cooling. The specimen was, for a $2^{nd}$ treatment, placed in a furnace capable of achieving a pressure $<10^{-4}$ mbar. The Furnace was heated to 680° C. and held there for 16 hours. The furnace was cooled down using furnace cooling.

Figure 16:
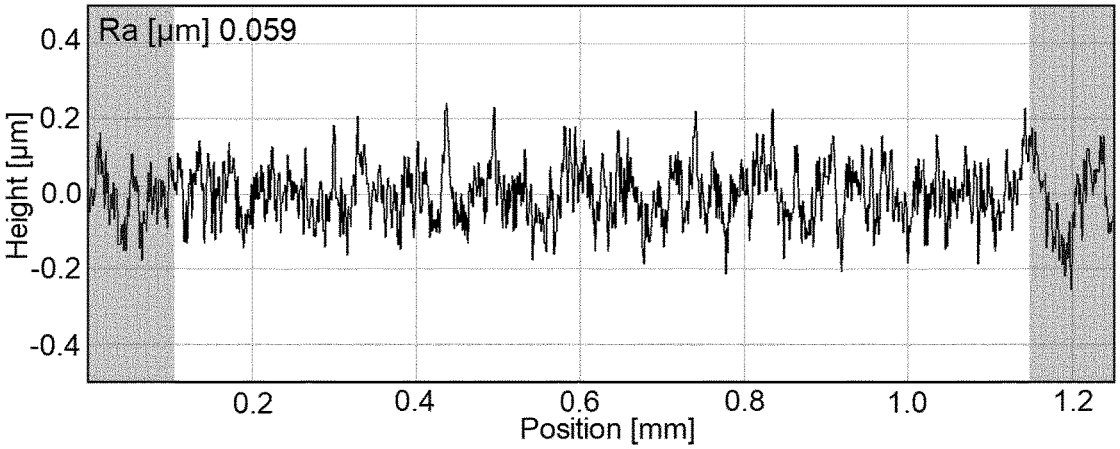
FIG. 16 shows a roughness measurement of mirror polished component of the invention.
Figure 17:
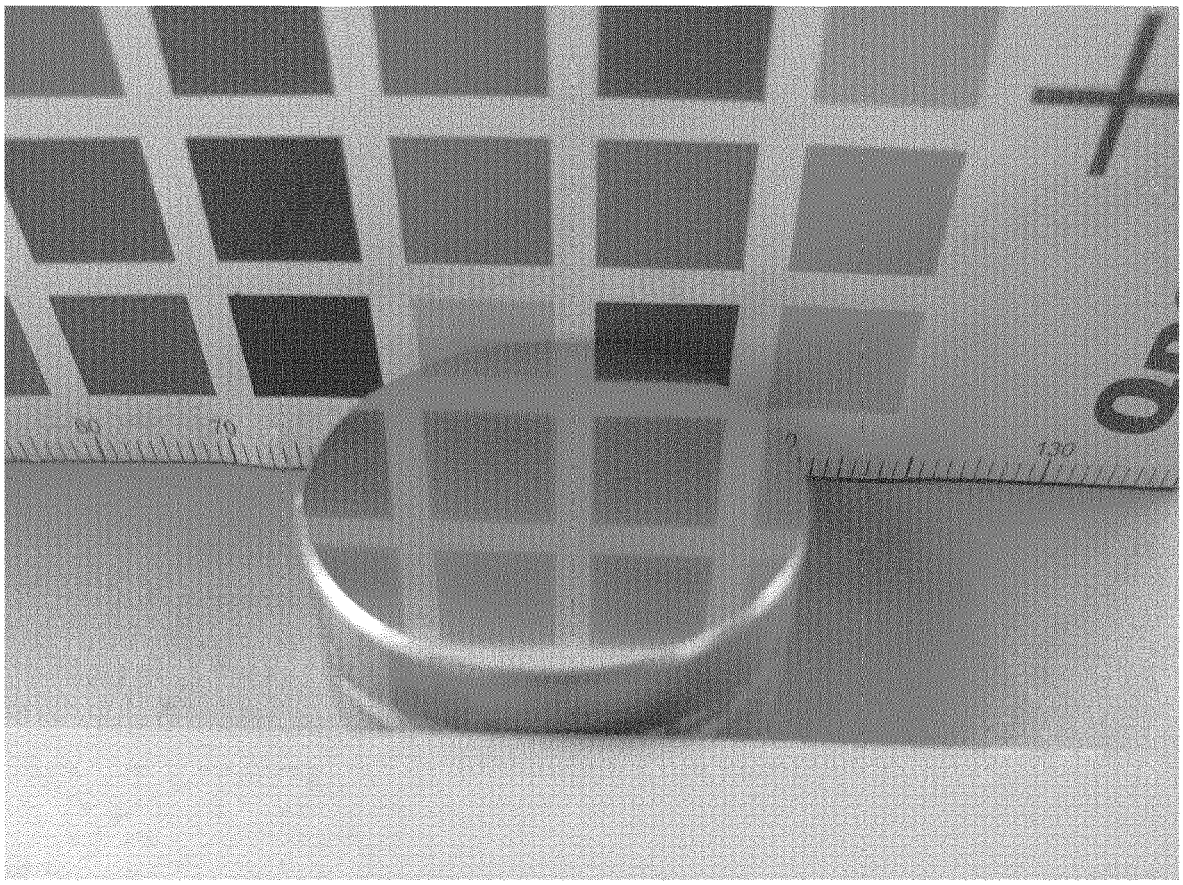
FIG. 17 shows a photographic representation of a mirror polished component of the invention.

The Ra value of the surface on the specimen was measured using the same procedure as prior to the thermochemical treatment (described above). The specimen still displays a surface roughness with a Ra value of <0.1 μm. The surface roughness is shown in FIG. 16. In FIG. 16 a graphical representation of the surface roughness after treatment, as measured by the Taylor-Hubson Surtronic S25, is shown. FIG. 17 shows a photo of the mirror polished surface after applying the thermochemical low temperature hardening. FIG. 17 shows how the shapes in the plot next to the specimen are reflected in the surface of the specimen, and in particular, the reflections are shown without distortion and the colours of the plot are also reflected in the surface.

The invention claimed is:

1. A method of oxygen hardening a Group IV metal, the method comprising the steps of:

providing a workpiece of a Group IV metal in its final shape;

oxidising the Group IV metal over an oxidising duration of at least 10 minutes in an oxidising atmosphere at a first temperature to provide a non-stratified Group IV metal oxide on the surface of the workpiece using a gaseous oxidising species selected from $CO_2$, $N_2O$ and combinations of $CO_2$ and $N_2O$, the gaseous oxidising species having an upper temperature limit of up to 800° C. wherein the first temperature is in the range of 500° C. and the upper temperature limit of the gaseous oxidising species;

diffusing oxygen from the non-stratified Group IV metal oxide into the Group IV metal in an inert atmosphere at a second temperature in the range of 500° C. to 800° C. and at a partial pressure of the gaseous oxidising species of up to $10^{-4}$ mbar over a diffusive duration of at least 2 hours to provide a superficial diffusion zone comprising oxygen in solid solution.

2. The method of oxygen hardening a Group IV metal according to claim 1, wherein the gaseous oxidising species is $CO_2$, the upper temperature limit is 800° C., and the oxidising duration is in the range of 1 hour to 16 hours.

3. The method of oxygen hardening a Group IV metal according to claim 1, wherein the gaseous oxidising species is $N_2O$, the upper temperature limit is 700° C., and the oxidising duration is in the range of 10 minutes to 2 hours.

4. The method of oxygen hardening a Group IV metal according to claim 1, wherein the pressure in the oxidising atmosphere is ambient pressure.

5. The method of oxygen hardening a Group IV metal according to claim 1, wherein the first temperature is in the range of 600° C. to 700° C.

6. The method of oxygen hardening a Group IV metal according to claim 1, wherein the total pressure in the inert atmosphere is up to $10^{-4}$ mbar.

7. The method of oxygen hardening a Group IV metal according to claim 1, wherein the inert atmosphere is a noble gas.

8. The method of oxygen hardening a Group IV metal according to claim 1, wherein the second temperature is in the range of 650° C. to 750° C.

9. The method of oxygen hardening a Group IV metal according to claim 8, wherein the diffusive duration is in the range of 2 hours to 40 hours.

10. The method of oxygen hardening a Group IV metal according to claim 1, wherein the Group IV metal comprises aluminium as an alloying element, and the first temperature is in the range of 500° C. to 700° C.

11. The method of oxygen hardening a Group IV metal according to claim 1, wherein the oxidising atmosphere further comprises CO.

12. The method of oxygen hardening a Group IV metal according to claim 1, wherein the workpiece of a Group IV metal is polished prior to oxidising the Group IV metal to provide a surface roughness of <0.1 μm in accordance with the ISO 1302:2002 standard.

13. The method of oxygen hardening a Group IV metal according to claim 1, wherein the gaseous oxidising species is $CO_2$, the first temperature is in the range of 600° C. to 750° C., the oxidising duration is in the range of 1 hour to 8 hours, the second temperature is in the range of 650° C. to 750° C., and the diffusive duration is in the range of 2 to 8 times the oxidising duration.

14. The method of oxygen hardening a Group IV metal according to claim 1, wherein the gaseous oxidising species is $CO_2$, the first temperature and the second temperature are both in the range of 650° C. to 700° C. with the second temperature being higher than the first temperature, the oxidising duration is in the range of 2 hours to 6 hours, and the diffusive duration is in the range of 3 to 6 times the oxidising duration.

15. The method of oxygen hardening a Group IV metal according to claim 1, wherein the gaseous oxidising species is $N_2O$, the first temperature is in the range of 600° C. to 650° C., the oxidising duration is in the range of 30 minutes to 2 hours, the second temperature is in the range of 650° C. to 700° C., and the diffusive duration is in the range of 4 to 20 times the oxidising duration.

16. The method of oxygen hardening a Group IV metal according to claim 1, wherein the oxidising atmosphere is a mixture of $CO_2$ and CO with 40% to 90% $CO_2$ compared to the total of $CO_2$ and CO.

17. The method of oxygen hardening a Group IV metal according to claim 1, wherein the oxidising atmosphere is a mixture of $N_2O$ and CO with 40% to 60% $N_2O$ compared to the total of $N_2O$ and CO.

18. A Group IV metal component comprising a material core having a core hardness and a surface hardness of at least 400 $HV_{0.025}$ and at least the core hardness +200 $HV_{0.025}$, a superficial diffusion zone having oxygen in solid solution at a level providing a hardness of at least 120% of the core hardness over a thickness from the surface in the range of 10 μm to 100 μm, the diffusion zone further containing carbon and/or nitrogen in solid solution at a concentration showing a local maximum in the diffusion zone of the carbon content and/or the nitrogen content as detectable with Glow Discharge Optical Emission Spectroscopy (GDOES).

19. The Group IV metal component according to claim 18, wherein the surface hardness is at least 650 $HV_{0.025}$.

20. The Group IV metal component according to claim 18, wherein the component has a surface roughness of <0.1 μm in accordance with the ISO 1302:2002 standard.

21. The Group IV metal component according to claim 18, wherein the diffusion zone has a thickness of at least 5 μm.

22. The Group IV metal component according to claim 18, wherein the Group IV metal is selected from the list consisting of titanium, a titanium alloy, zirconium, and a zirconium alloy.

23. The Group IV metal component according to claim 22, wherein the titanium is titanium of grade 2, 4, or 5 or wherein the zirconium is Zr702 zirconium.

* * * * *